US007296604B2

(12) United States Patent
Suzuki

(10) Patent No.: US 7,296,604 B2
(45) Date of Patent: Nov. 20, 2007

(54) METHOD OF PROCESSING WOOD

(75) Inventor: Tatsuya Suzuki, Tokyo (JP)

(73) Assignee: Olympus Corporation, Tokyo (JP)

( * ) Notice: Subject to any disclaimer, the term of this patent is extended or adjusted under 35 U.S.C. 154(b) by 0 days.

(21) Appl. No.: 11/356,860

(22) Filed: Feb. 17, 2006

(65) Prior Publication Data

US 2006/0156665 A1 Jul. 20, 2006

Related U.S. Application Data

(63) Continuation of application No. PCT/JP2005/019843, filed on Oct. 21, 2005.

(30) Foreign Application Priority Data

Oct. 22, 2004 (JP) ..... 2004-308612
Oct. 22, 2004 (JP) ..... 2004-308613

(51) Int. Cl.
*B27F 1/00* (2006.01)
*B27F 5/00* (2006.01)
*B27M 3/00* (2006.01)

(52) U.S. Cl. ..... 144/345; 144/359; 144/381; 428/106

(58) Field of Classification Search ..... 144/329, 144/344, 345, 359, 381, 361, 362, 380, 364, 144/2.1, 3.1, 360, 352; 428/105, 106, 114; 264/112, 113, 119; 100/35
See application file for complete search history.

(56) References Cited

U.S. PATENT DOCUMENTS 1,566,863 A * 12/1925 Harrison ..... 428/496
1,707,135 A * 3/1929 Ollesheimer ..... 428/106
1,738,172 A * 12/1929 Judson et al. ..... 174/520
2,017,037 A * 10/1935 Brown ..... 144/380
4,388,133 A * 6/1983 Hirao et al. ..... 156/245
4,931,124 A * 6/1990 Baum ..... 156/245
5,746,863 A * 5/1998 Jarrett ..... 156/218
5,800,293 A * 9/1998 MacKay, Jr. ..... 473/464
6,286,571 B1 * 9/2001 Wiklund ..... 144/378
6,418,990 B1 * 7/2002 Lindstrom ..... 144/348
6,446,412 B2 * 9/2002 Mathis ..... 52/730.7
2004/0250912 A1 12/2004 Haller et al.

FOREIGN PATENT DOCUMENTS

| | | | |
|---|---|---|---|
| DE | 971038 | | 11/1958 |
| DE | 10224721 | A1 * | 1/2003 |
| EP | 0 673 732 | A1 | 9/1995 |
| JP | 08-025301 | | 1/1996 |
| JP | 11-077619 | | 3/1999 |
| WO | 2006/043731 | | 4/2006 |

* cited by examiner

*Primary Examiner*—Bena Miller
(74) *Attorney, Agent, or Firm*—Hogan & Hartson LLP

(57) ABSTRACT

A method of processing wood into a predetermined shape through compression includes compressing a first wooden piece and a second wooden piece separately; placing the compressed second wooden piece on the compressed first wooden piece; and compressing together the compressed first wooden piece and the compressed second wooden piece which are placed one on another.

13 Claims, 22 Drawing Sheets

METHOD OF PROCESSING WOOD

CROSS-REFERENCE TO RELATED APPLICATIONS

This application is a continuation of PCT international application Ser. No. PCT/JP2005/019843 filed Oct. 21, 2005 which designates the United States, incorporated herein by reference, and which claims the benefit of priority from Japanese Patent Applications No. 2004-308612 and No. 2004-308613, both filed Oct. 22, 2004, incorporated herein by reference.

BACKGROUND OF THE INVENTION

1. Field of the Invention

The present invention relates to a method of processing wood, according to which a wooden piece is compressed and deformed into a predetermined shape.

2. Description of the Related Art

In recent years, techniques for processing wood by compressing and forming the same into a desired shape have been focused. With a wide variety of grain patterns, wood products made of wood exhibit individual features depending on positions of the raw wood from which the particular wood products are cut out. Such individual features of each wood product give it a unique quality. In addition, surface damages and discoloration caused by a long-term use create unique textures which tend to evoke warm and familiar feeling in the user. Thus, the wood attracts attention as a material for products of uniqueness and taste which cannot be found in products made of synthetic resin or light metals.

According to one conventionally known technique for compression processing of wood: a wooden board is softened with water absorption and compressed; the compressed wooden board is cut along a direction substantially parallel with a direction in which the compressing force is applied, whereby a primary fixed product with a sheet-like shape is obtained; and the primary fixed product is deformed into a desired three-dimensional shape under heat and moisture (for example, see Japanese Patent No. 3078452 Publication). Further, according to another conventional technique, a softened wooden board is compressed and temporarily secured in a prepared mold and left in the mold until the wooden board recovers. Thus a wood product with a desired shape can be obtained (see, for example, Japanese Patent Application Laid-Open No. H11-77619 Publication).

For the implementation of compression process of wooden pieces, a thickness of a wooden piece to be employed and a compression rate must be determined based on various factors such as an individual characteristic of each wooden piece, wood species, and a required strength and a purpose of use of a resulting wood product.

SUMMARY OF THE INVENTION

A method of processing wood into a predetermined shape through compression, according to one aspect of the present invention, includes compressing a first wooden piece and a second wooden piece separately; placing the compressed second wooden piece on the compressed first wooden piece; and compressing together the compressed first wooden piece and the compressed second wooden piece which are placed one on another.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, exemplary embodiments of the present invention will be described with reference to the accompanying drawings.

Figure 1:
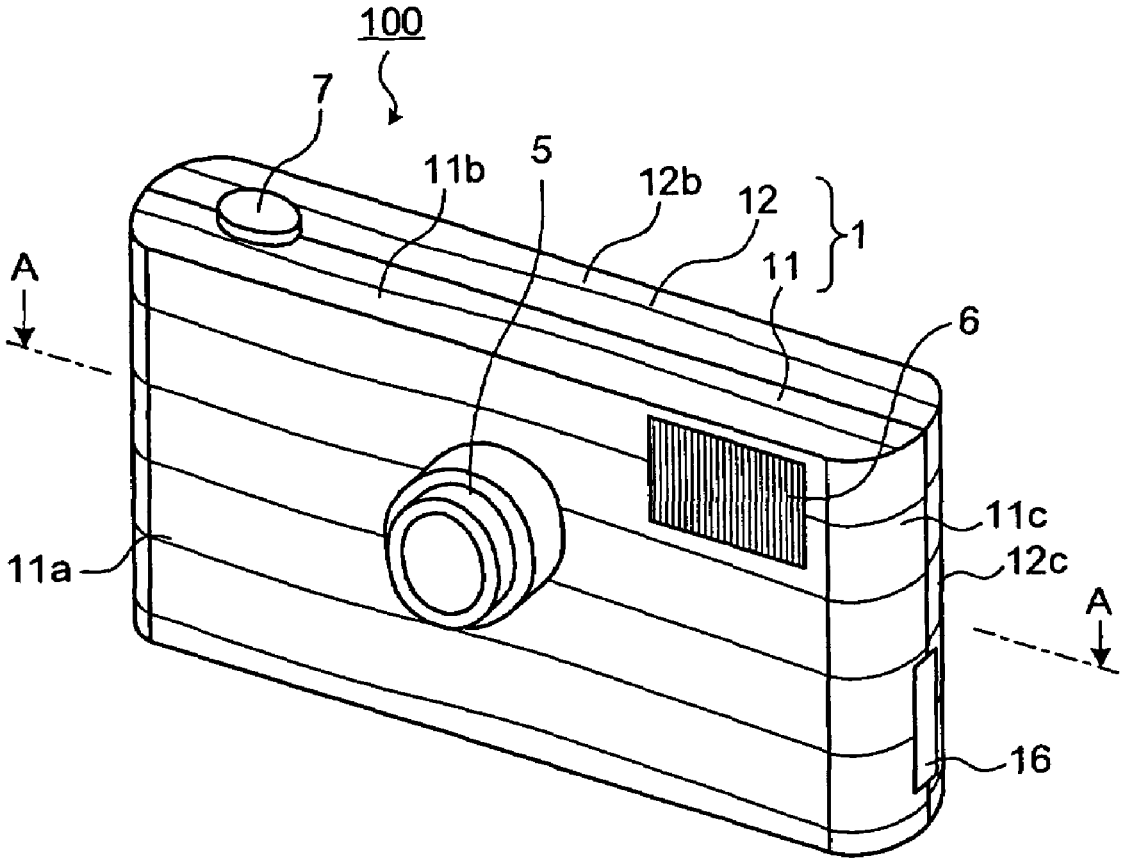
FIG. 1 is a perspective view of a structure of an electronic device whose jacket is made of a compressed wood product formed through a method of processing wood according to a first embodiment of the present invention.

FIG. 1 is a perspective view of a structure of an electronic device whose jacket is made of a compressed wood product formed through a method of processing wood according to a first embodiment of the present invention. The electronic device shown in FIG. 1 is a digital camera 100 which encloses various electronic elements inside a substantially rectangular solid jacket 1 formed from wooden covers 11 and 12 joined together, each formed like a bowl.

Figure 2:
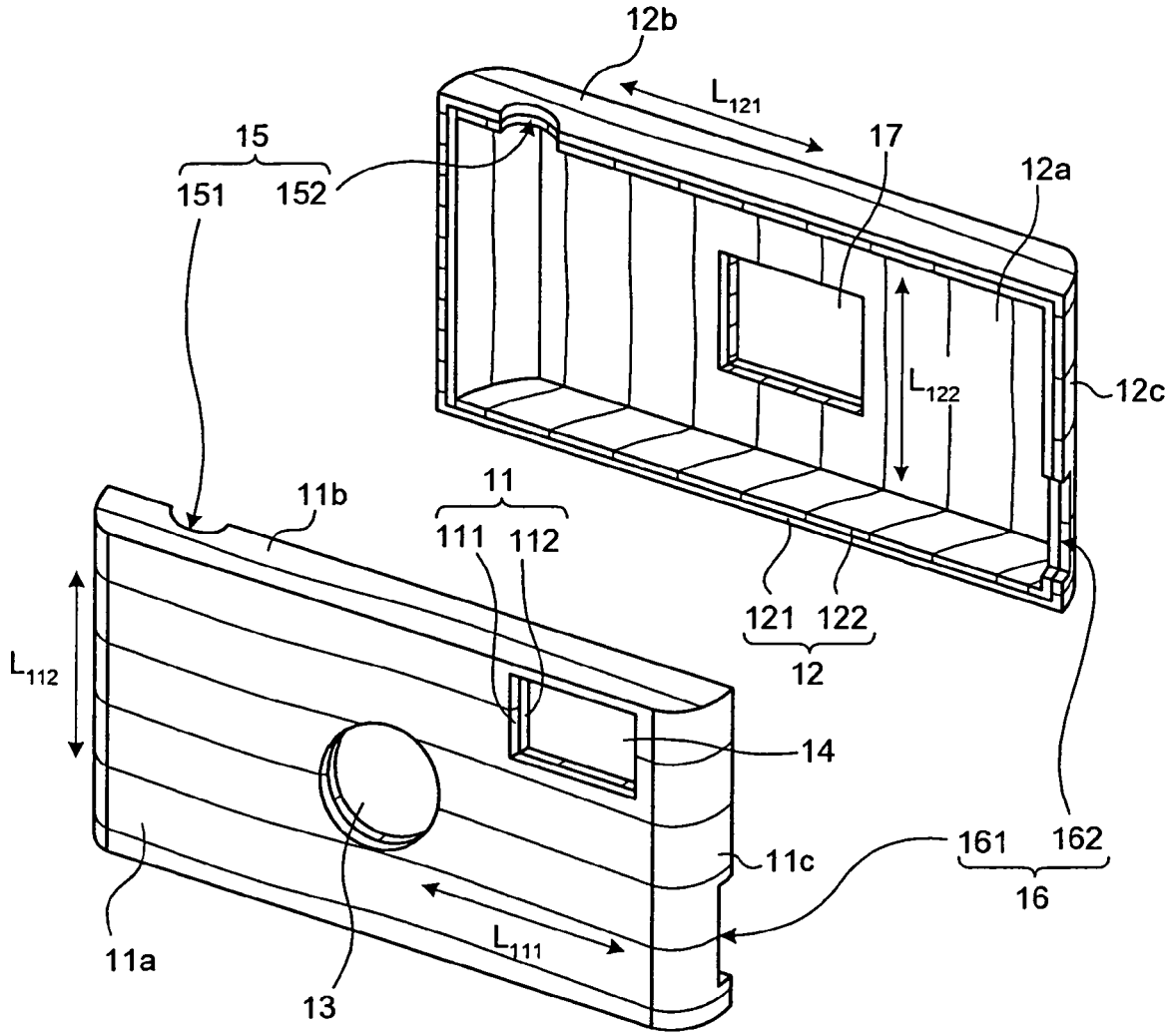
FIG. 2 is a perspective view of a structure of the compressed wood product formed through the method of processing wood according to the first embodiment.

FIG. 2 is a perspective view of a structure of the covers 11 and 12. The cover 11 includes a main plate 11*a* which has a substantially rectangular surface, two side plates 11*b* that extend from respective opposing longer sides of the main plate 11*a* in a direction substantially perpendicular to the main plate 11*a*, and two side plates 11*c* that extend from respective opposing shorter sides of the main plate 11*a* in a direction substantially perpendicular to the main plate 11*a*.

The cover 12 is of substantially the same shape as the cover 11, and includes a main plate 12*a* which has a substantially rectangular surface, two side plates 12*b* that extend from respective opposing longer sides of the main plate 12*a* in a direction substantially perpendicular to the main plate 12*a*, and two side plates 12*c* that extend from respective opposing shorter sides of the main pate 12*a* in a direction substantially perpendicular to the main plate 12*a*.

Figure 3:
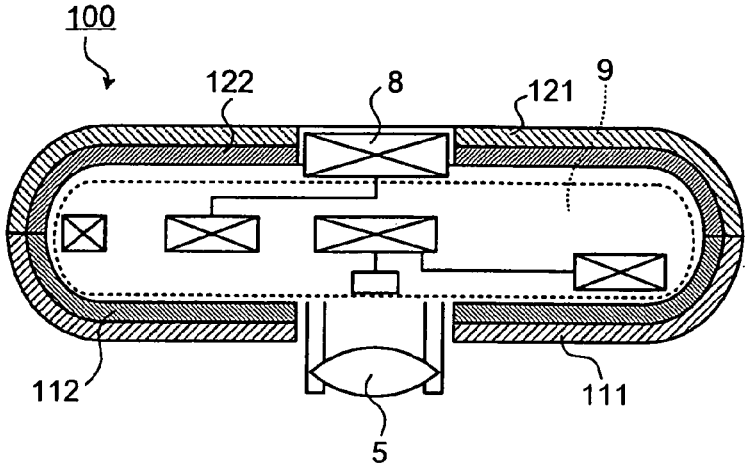
FIG. 3 is a sectional view of the compressed wood product along a line A-A shown in FIG. 1.

FIG. 3 is a sectional view along a line A-A shown in FIG. 1. As shown in FIG. 2 and FIG. 3, each of the covers 11 and 12 is formed through a compression of two separately compressed wooden sheets. More specifically, the cover 11 is formed from two layers, i.e., an outer part 111 and an inner part 112, whereas the cover 12 is formed from two layers, i.e., an outer part 121 and an inner part 122.

In the outer part 111, wooden fibers run in a direction $L_{111}$ which is substantially parallel with the lengthwise direction of the cover 11, whereas in the inner part 112, wooden fibers run in a direction $L_{112}$ which is substantially parallel with the breadthwise direction of the cover 11. In the outer part 121, wooden fibers run in a direction $L_{121}$ which is substantially parallel with the lengthwise direction of the cover 12, whereas in the inner part 122, wooden fibers run in a direction $L_{122}$ which is substantially parallel with the breadthwise direction of the cover 12. Thus, the direction of wooden fibers in the outer part is substantially perpendicular to the direction of wooden fibers in the inner part in each cover.

The main plate 11*a* of the cover 11 has openings 13 and 14 exposing an imaging unit 5 having an image pick-up lens and a photoflash 6, respectively. The side plates 11*b* and 11*c* of the cover 11 have cut-out portions 151 and 161, respectively.

On the other hand, the main plate 12*a* of the cover 12 includes an opening 17 to expose a display unit 8 which is implemented by a liquid crystal display, a plasma display, an organic electroluminescence (EL) display or the like for display of image information or textual information. Over the opening 17, a protective member made of glass or the like is mounted to protect the display unit 8. The side plates 12*b* and 12*c* of the cover 12 include cut-out portions 152 and 162, respectively.

When the covers 11 and 12 with the above-described structures are joined together in an assembly of the digital camera 100, the cut-out portions 151 and 152 face with each other to form an opening 15, whereas the cut-out portions 161 and 162 face with each other to form an opening 16. The opening 15 exposes a shutter button 7, whereas the opening 16 exposes a connection device for connecting to an external device such as a personal computer. The connection device is, for example, a connection terminal such as a universal serial bus (USB) terminal, a connection port for an external storage media such as an xD picture card, a smart media or the like, and a receptacle for power supply. A cap may be provided to the opening 16 for protection of the connection device not in use.

Further, the covers 11 and 12 may include an additional opening and an additional cut-out portion to mount a finder or to expose a manual operation button.

The jacket 1 houses, as shown in FIG. 3, at least a part of electronic elements which realize electronic functions of the digital camera 100, and more particularly, a control unit 9 which includes a control circuit that controls driving related to imaging process or the like of the digital camera 100, an imaging element such as a charge coupled device (CCD), and electronic units including an audio input-output element such as a microphone, speaker, or the like. The control circuit is realized with a central processing unit (CPU) having functions of operation and control, and a flash memory which stores various information such as a program for launching a predetermined operating system (OS).

When the covers 11 and 12 are assembled to form the jacket 1 so as to house the electronic elements, adhesive or the like is applied to corresponding end surfaces of the side plates of the covers 11 and 12. After joining two covers, a periphery of the interface of two covers may be covered with sealant, such as an elastic material and sealed. Alternatively, a groove may be formed on an end of a side plate of one of two covers 11 and 12, and a protrusion which would fit the groove may be formed on an end of a side plate of the other cover, and the protrusion may be fit into the groove at the joining.

Figure 4:
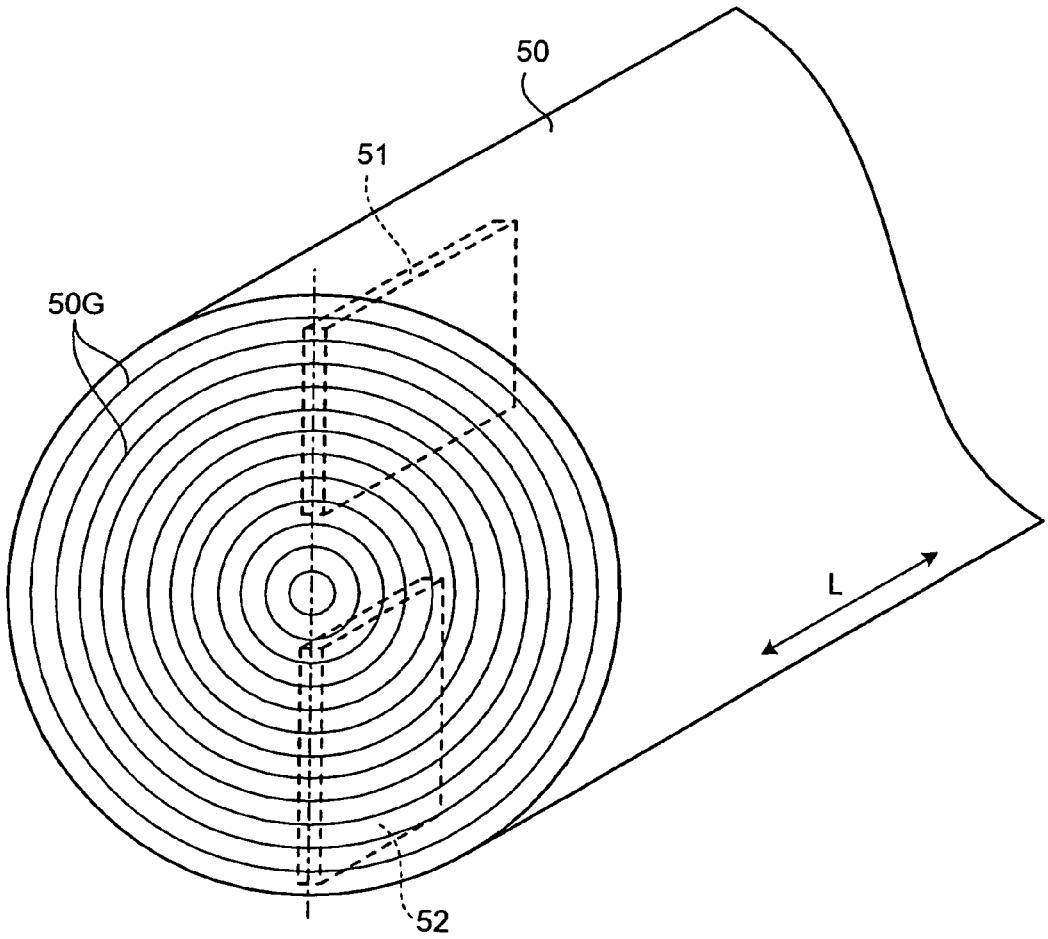
FIG. 4 is an explanatory diagram schematically showing how a wooden piece from which the compressed wood product is formed through the method of processing wood according to the first embodiment is cut out from raw wood.
Figure 5:
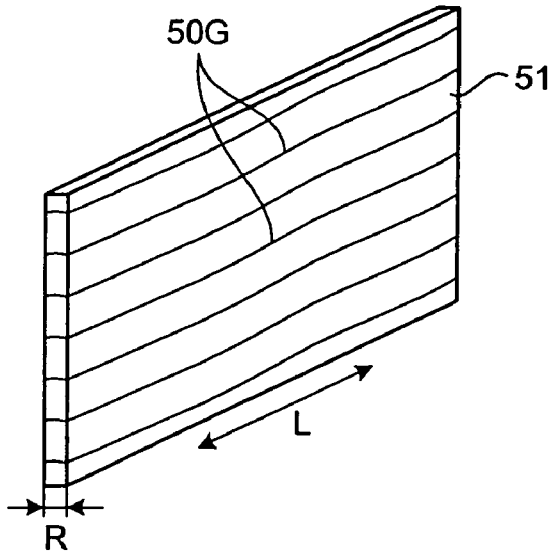
FIG. 5 is a perspective view of a structure of a wooden piece which is processed into an outer part of the compressed wood product formed through the method of processing wood according to the first embodiment.

Next, a method of processing the cover into the above-described structure is described in detail. First, wooden pieces are cut out from raw wood as material for the cover 11 or 12. FIG. 4 is an explanatory diagram which schematically shows shaping of the wooden pieces to be processed into the cover 11 and 12, from uncompressed raw wood 50. A wooden piece 51, which is a material for the outer part 111 or 121, is a planar sheet and cut out from the raw wood 50 so that a lengthwise direction of the wooden piece 51 is substantially parallel with a direction L of wooden fibers of the raw wood 50. The wooden piece 51 thus shaped, as shown in FIG. 5, has a straight grain surface where grains 50 G run substantially parallel with each other, and has a thickness R.

Figure 6:
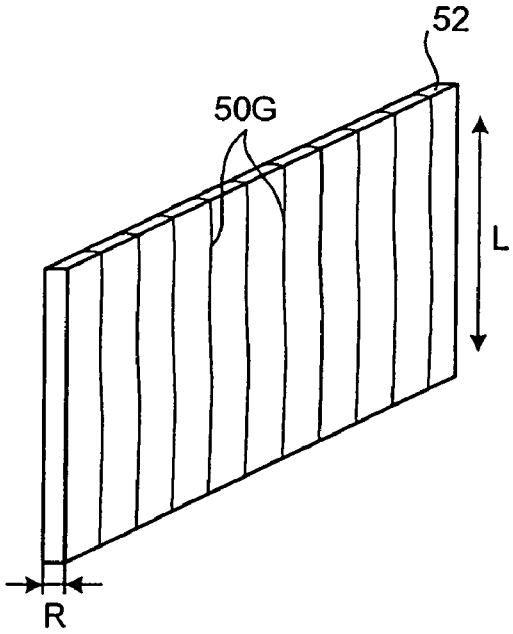
FIG. 6 is a perspective view of a structure of a wooden piece which is processed into an inner part of the compressed wood product formed through the method of processing wood according to the first embodiment.

On the other hand, a wooden piece 52, which is a material for the inner part 112 or 122, is a planar sheet and cut out from the raw wood 50 so that a breadthwise direction of the wooden piece 52 is substantially parallel with the direction L of wooden fibers of the raw wood 50. FIG. 6 is a perspective view of a structure of the cut-out wooden piece 52. The wooden piece 52, similar to the wooden piece 51, has the thickness R and a straight grain surface, but is shorter in length in a lengthwise direction than the wooden piece 51.

Here, the wooden pieces 51 and 52 are cut out from the raw wood 50, so that the cut-out wooden pieces 51 and 52 are larger in volume than finished pieces by an amount to be decreased in the compression process described later. The raw wood which is employable in the first embodiment is, for example, Japanese cypress, hiba cedar, paulownia, Japanese cedar, pine, cherry, zelkova, ebony wood, teak, mahogany, and rosewood. Any of these wood species can be employed as the raw wood in all embodiments of the present invention.

Figure 7:
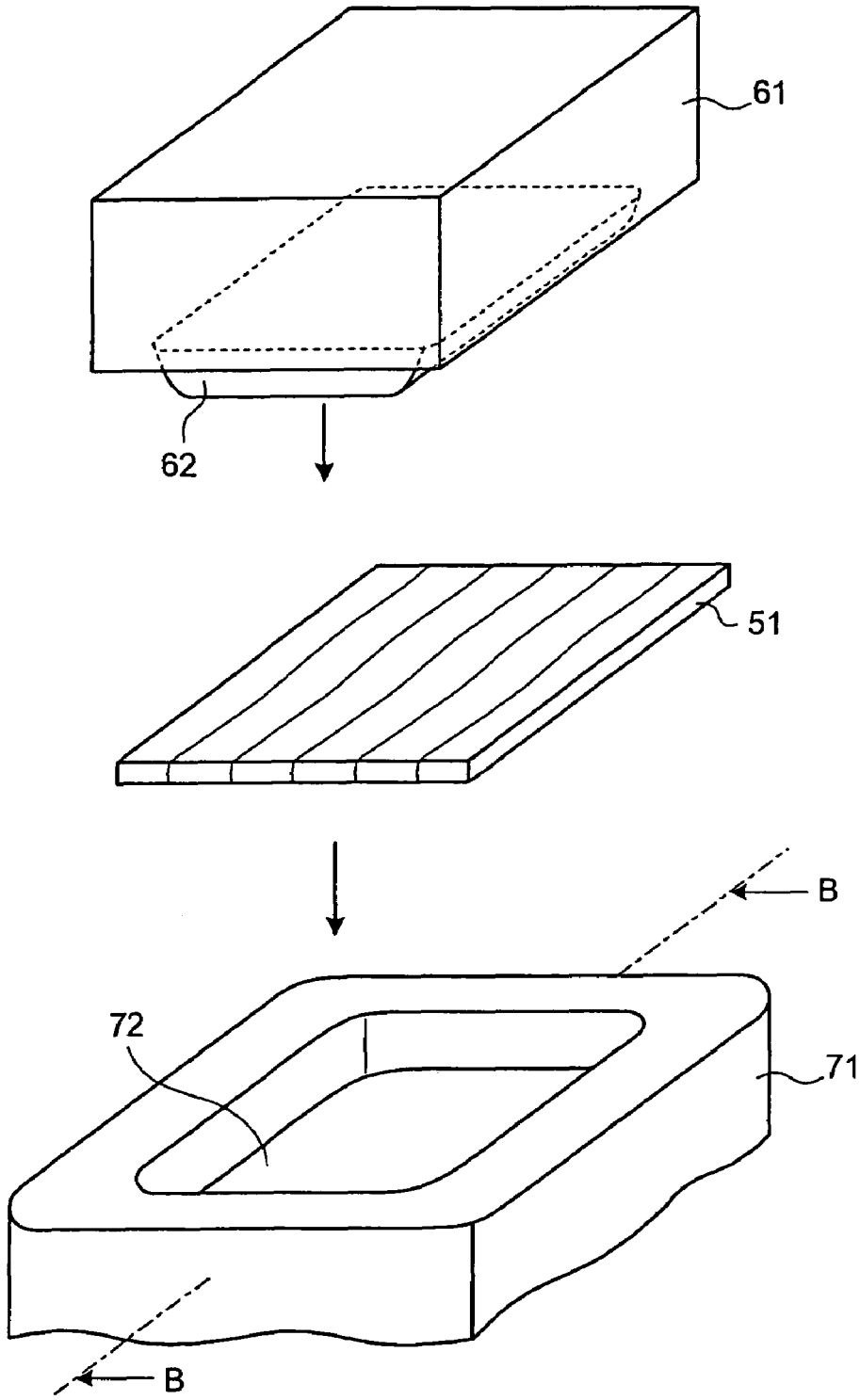
FIG. 7 is an explanatory diagram schematically showing how a wooden piece is processed in a first compression process of the method of processing wood according to the first embodiment.
Figure 8:
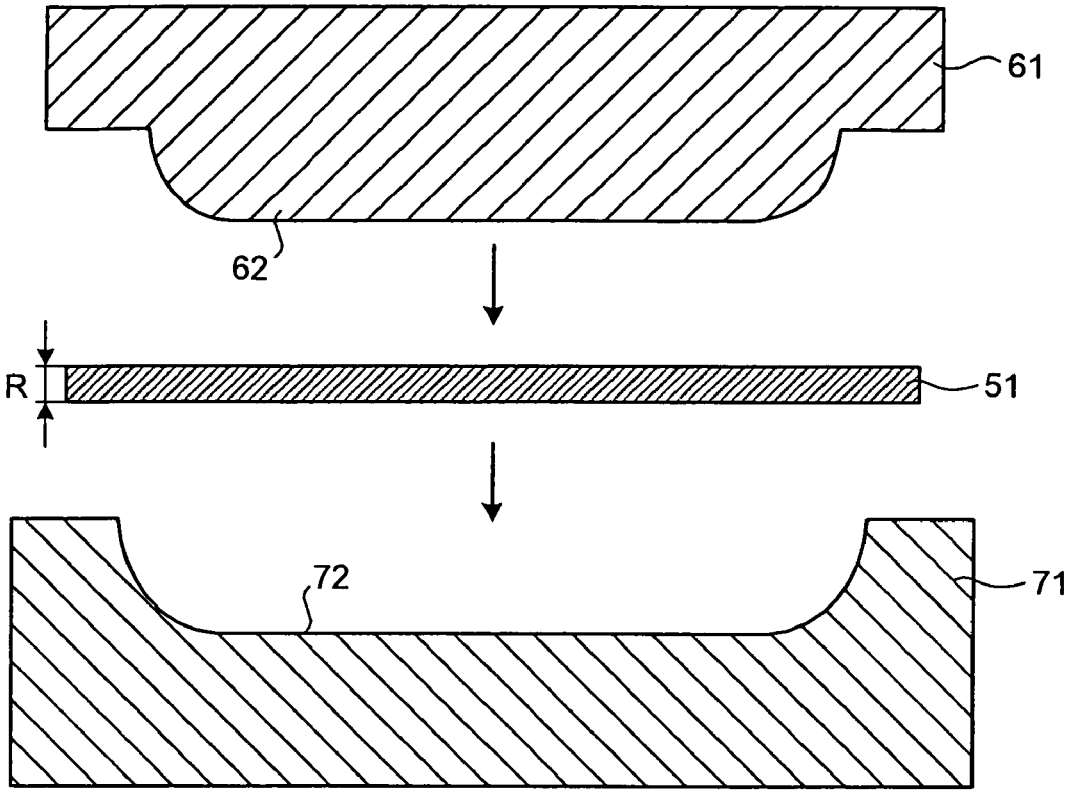
FIG. 8 is a sectional view of metal molds and the wooden piece along a line B-B shown in FIG. 7.

After the cutting out, the wooden piece 51 is compressed (first compression process). FIG. 7 is an explanatory diagram schematically showing how the first compression process of the wooden piece 51 is carried out, and FIG. 8 is a sectional view of the wooden piece 51 and metal molds along a line B-B shown in FIG. 7. As shown in FIGS. 7 and 8, the wooden piece 51 is compressed by two metal molds 61 and 71 in the first compression process. Of these two metal molds, the metal mold 61 used to apply compressing force to the wooden piece 51 from above the wooden piece 51 has a downward protrusion 62. On the other hand, the metal mold 71 used to apply compressing force to the wooden piece 51 from below the wooden piece 51 during the compression process has a downward depression 72.

Figure 9:
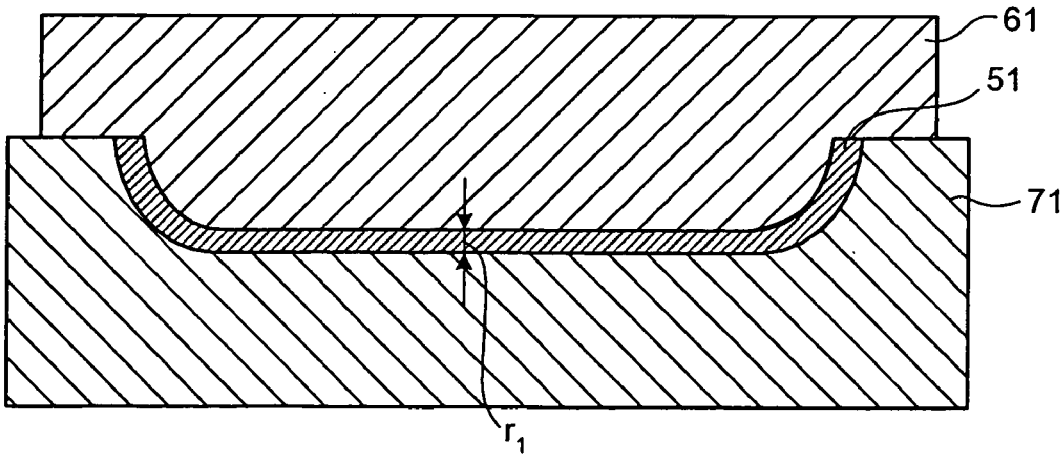
FIG. 9 is a vertical sectional view of the wooden piece compressed between the metal molds in the first compression process.

Before the first compression process, the wooden piece 51 is left in a water vapor atmosphere in high temperature and high pressure for a predetermined time period. Thus, the wooden piece 51 absorbs water in excess to be softened. Thereafter, at least one of the metal molds 61 and 71 is brought closer to another of the metal molds 61 and 71 in the same water vapor atmosphere to sandwich and compress the wooden piece 51. FIG. 9 is a vertical sectional view of the wooden piece 51 sandwiched and compressed by the metal molds 61 and 71, along the line B-B of FIG. 7, similarly to FIG. 8. As shown in FIG. 9, the wooden piece 51 is deformed into a substantially bowl-like three-dimensional shape corresponding to a gap formed between the protrusion 62 and the depression 72, while being sandwiched and compressed by two metal molds 61 and 71.

According to the first embodiment, the wooden piece 51 is deformed to have a uniform thickness $r_1$ (<R) over the whole area thereof by the first compression process. A compression rate $C_1$ of the wooden piece 51 in the first compression process can be represented as $(R-r_1)/R$. Specifically, the compression rate $C_1$ is approximately in the range of 0.3 to 0.6.

After the wooden piece 51 is left in the state as shown in FIG. 9 for a predetermined time period, the metal mold 61 is separated from the metal mold 71 to release the wooden piece 51 from compression and water vapor atmosphere, and then the wooden piece 51 is dried. Depending on the material of the wooden piece 51, the wooden piece 51 may recover the original shape when released from the metal molds 61 and 71. When such type of wood is employed, the wooden piece 51 is left sandwiched between the metal molds 61 and 71 during the compression release and drying. The length of time for drying the wooden piece 51 may vary according to the shape and the species of the wooden piece 51.

Thus the first compression process for the wooden piece 51 is described. The first compression process is similarly carried out on the wooden piece 52. In the first compression process of the wooden piece 52, different metal molds from the metal molds 61 and 71 employed for the compression of the wooden piece 51 are employed, so that the wooden piece 52 after the first compression process is of a bowl-like shape slightly smaller than the wooden piece 51 after the first compression process, and has a thickness $r_2$ (<R) substantially over a whole area thereof. A compression rate $C_2$ of the wooden piece 52 in the first compression process can be represented as $(R-r_2)/R$.

In the first embodiment, the metal molds are designed so that the thickness $r_1$ of the wooden piece 51 and the thickness $r_2$ of the wooden piece 52 after the first compression process are equal. Hence, the compression rate $C_1$ of the wooden piece 51 and the compression rate $C_2$ of the wooden piece 52 in the first compression process are the same (i.e., $C_1=C_2$). Hereinafter, the wooden pieces 51 and 52 after the first compression process are referred to as the outer part 111 and the inner part 112, respectively.

After the first compression process described above, the outer part 111 and the inner part 112 are placed one on another and compressed together (second compression process). Hereinafter, the formation of the cover 11 will be described by way of example. The cover 12 is formed in the same manner.

Figure 10:
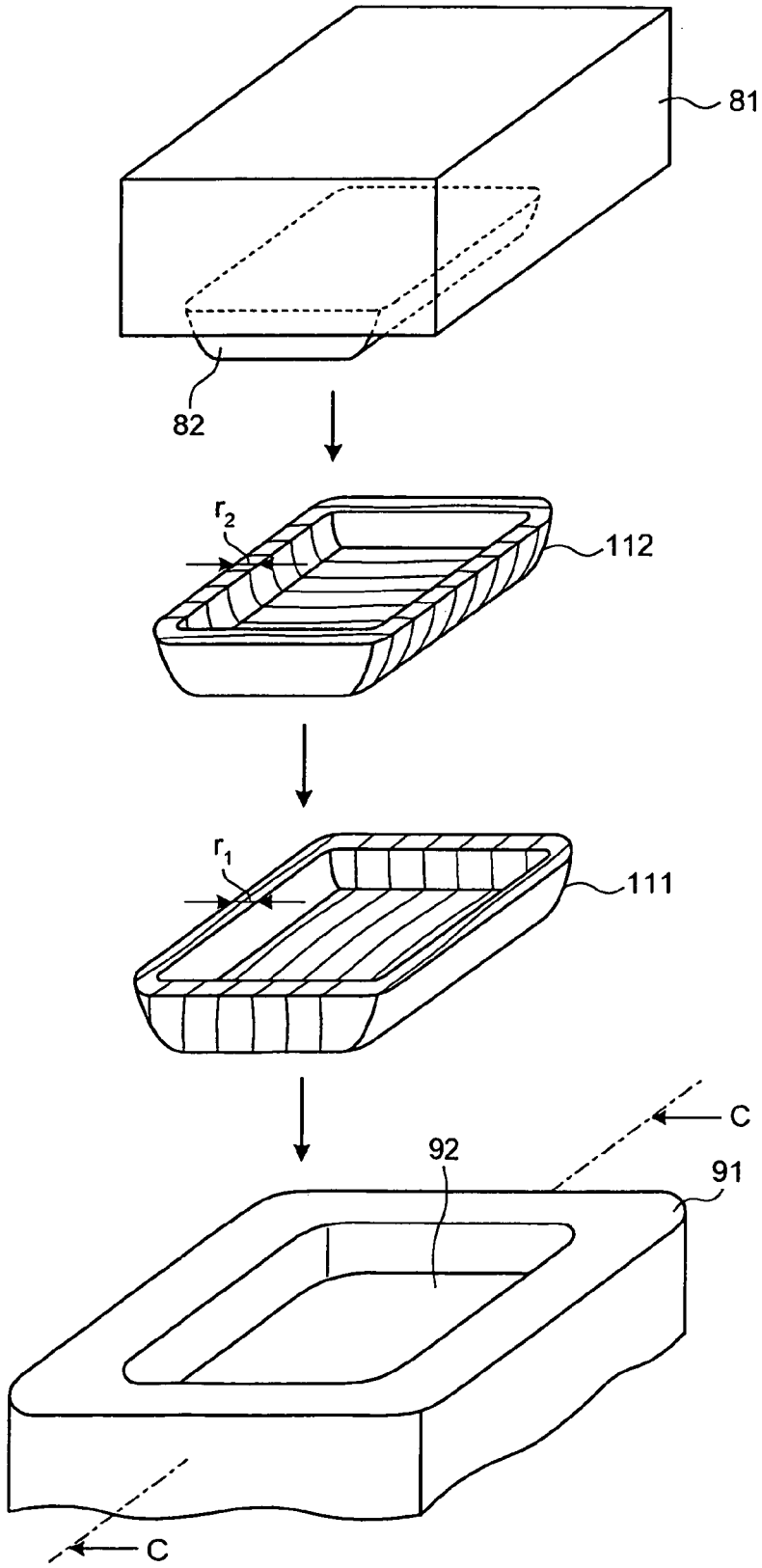
FIG. 10 is an explanatory diagram schematically showing how a wooden piece is processed in a second compression process of the method of processing wood according to the first embodiment.
Figure 11:
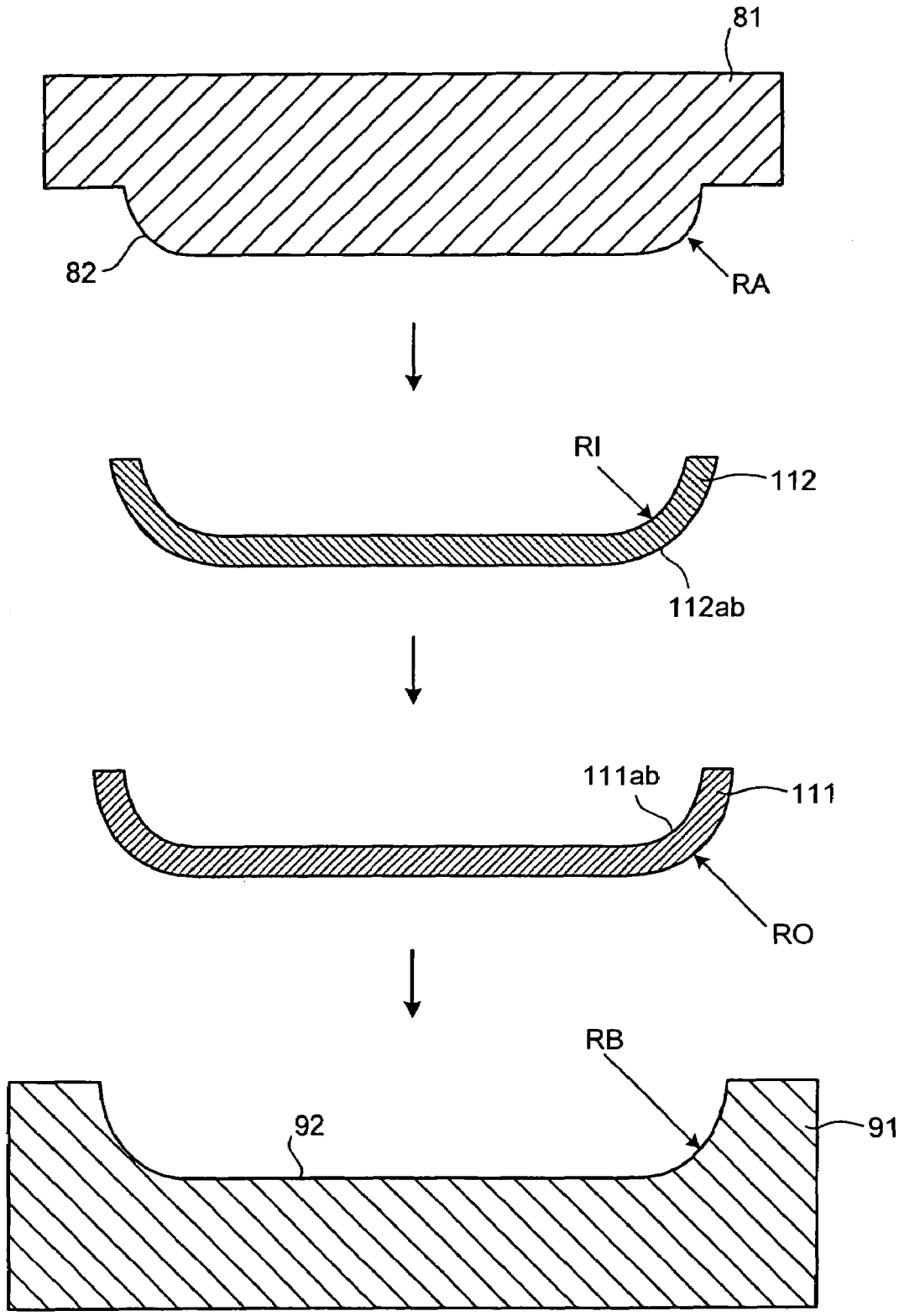
FIG. 11 is a sectional view of wooden pieces and metal molds along a line C-C shown in FIG. 10.

FIG. 10 is an explanatory diagram schematically showing how the second compression process is carried out, and FIG. 11 is a sectional view of the inner part, the outer part, and metal molds along a line C-C shown in FIG. 10. In the second compression process, the inner part 112 is placed over the outer part 111 in the same water vapor atmosphere of high temperature and high pressure as in the first compression process, and two parts 111 and 112 are placed at a predetermined location between metal molds 81 and 91. Then, two metal molds sandwich and compress the outer part 111 and the inner part 112 to deform the same into a predetermined shape.

The metal mold 81, which applies compressing force to the inner part 112 from above has a protrusion 82 which fits an inner surface of the inner part 112. The protrusion 82 has a curved surface which fits an inner surface of a curved portion 112*ab* extending between a bottom portion and a side portion of the inner part 112. A radius of curvature RA of the curved surface of the protrusion 82 is smaller than a radius of curvature RI of the inner surface of the curved portion 112*ab*. On the other hand, the metal mold 91 which applies compressing force to the outer part 111 from below has a depression 92 which fits an outer surface of the outer part 111. The depression 92 has a curved surface which fits an outer surface of a curved portion 111*ab* extending between a bottom portion and a side portion of the outer part 111. A radius of curvature RB of the curved surface of the depression 92 is smaller than a radius of curvature RO of the outer surface of the curved portion 111*ab*.

Figure 12:
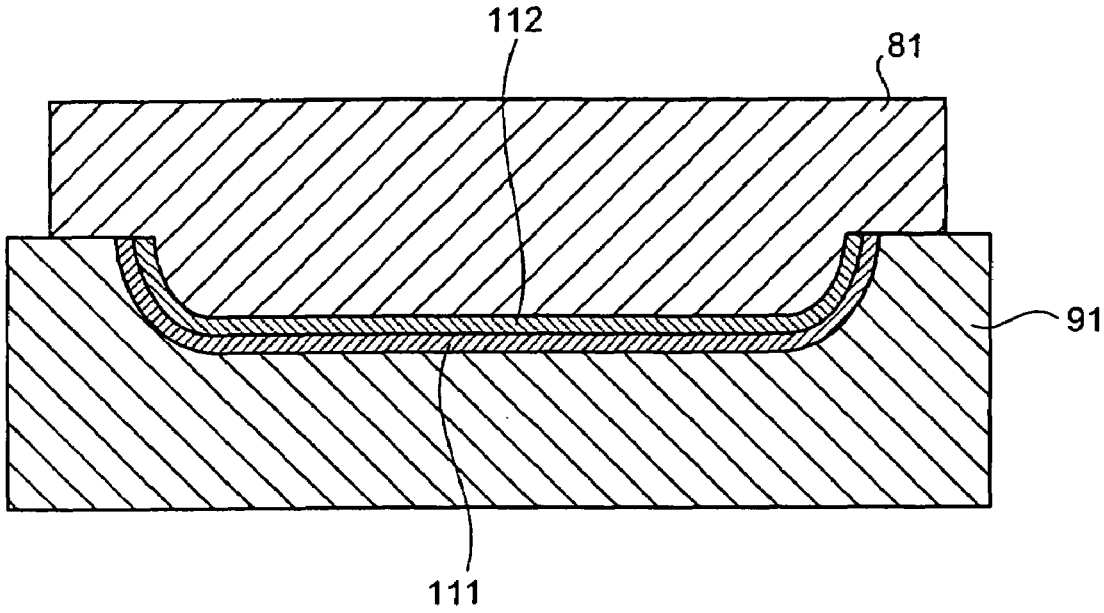
FIG. 12 is a vertical sectional view of an outer part and an inner part compressed together between the metal molds.

FIG. 12 is a vertical sectional view of the outer part 111 and the inner part 112 sandwiched and compressed by the metal molds 81 and 91, along the line C-C of FIG. 10, similarly to FIG. 11. The outer part 111 and the inner part 112 are further compressed in the state shown in FIG. 12. In the second compression process, sap components seep out from the outer part 111 and the inner part 112 to serve as adhesive, and hence, the outer part 111 and the inner part 112 stick with each other without application of adhesive. Here, depending on the material of the outer part 111 and the inner part 112, a suitable amount of adhesive may be applied to contact surfaces of the outer part 111 and the inner part 112 prior to the second compression process.

Figure 13:
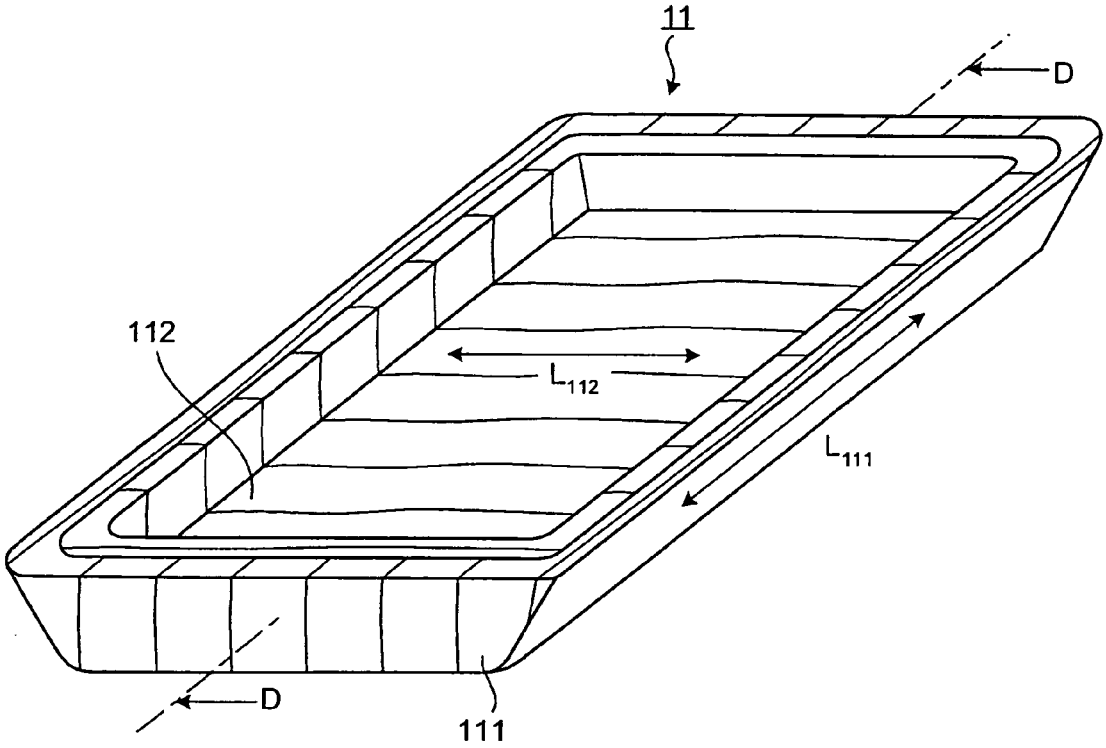
FIG. 13 is a perspective view of a structure of a cover formed through the compression process.
Figure 14:
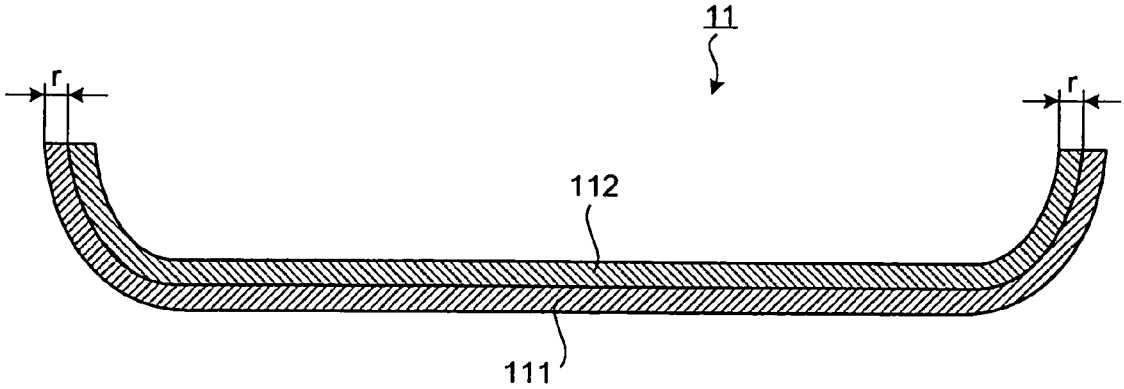
FIG. 14 is a sectional view of the cover along a line D-D shown in FIG. 13.

After the outer part 111 and the inner part 112 are left in the state as shown in FIG. 12 for a predetermined time period, the outer part 111 and the inner part 112 are released from compression and dried. FIG. 13 is a perspective view of an original structure of the cover 11 after the second compression process, and FIG. 14 is a sectional view of the cover 11 along a line D-D of FIG. 13. The outer part 111 and the inner part 112 after the second compression process are substantially the same in thickness, i.e., r, whereby the thickness of the cover 11 is approximately 2r. The thickness 2r is approximately 30% to 50% of 2R, which is a sum of thicknesses of two wooden pieces as cut out from the uncompressed raw wood. Therefore, a compression rate through two compression processes is approximately 0.5 to 0.7, which is slightly larger than the compression rate (approximately 0.3 to 0.6) in the first compression process.

Thereafter, with the formation of an opening, a cut-out portion or the like in a predetermined position via cutting or punching, the cover 11 is finished. When the finished cover 11 has an unnecessary portion on an outer periphery thereof, such portion is removed via cutting and a suitable processing is performed on a resulting surface.

Figure 15:
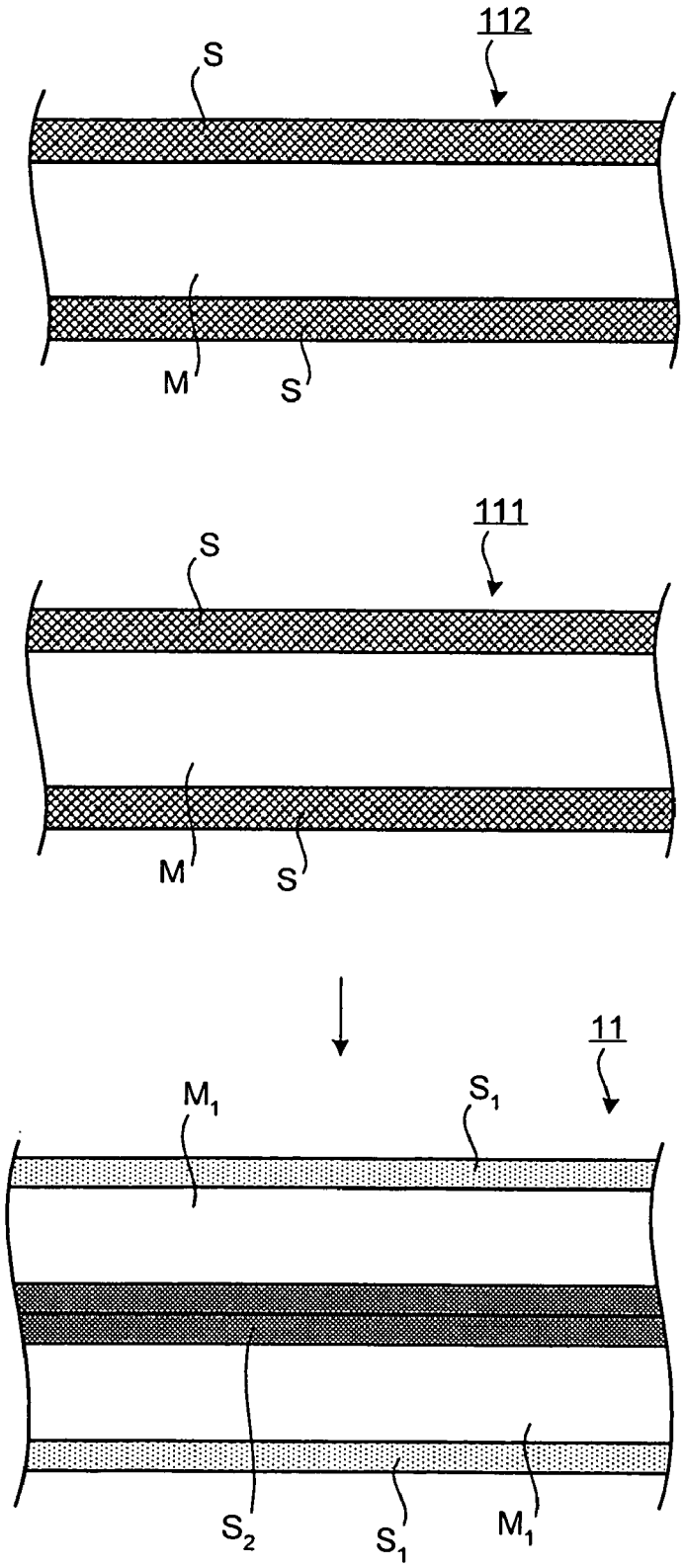
FIG. 15 is a vertical sectional view of the wooden piece after compression process where strength distribution is schematically shown.

FIG. 15 is a vertical sectional view which schematically shows examples of strength distribution in the outer part 111 and the inner part 112 that are processed into the cover 11 through compression as described above. The outer part 111 and the inner part 112 after the first compression process has a relatively higher strength in regions S in the vicinity of the surfaces which directly receive compressing force from the metal molds compared with intermediate regions M.

When the cover 11 is formed through the second compression process of the outer part 111 and the inner part 112 placed one on another, the cover 11 receives compressing force at regions $S_1$ in the vicinity of surfaces thereof to increase fiber density, whereby the strength thereof is further enhanced. In addition, a region $S_2$ in the vicinity of surfaces adhering with each other of the outer part 111 and the inner part 112 has a higher strength than intermediate regions $M_1$ though lower than the regions $S_1$, and the region S2 is relatively thick. Thus, a layer with relatively high strength is superimposed on a layer with relatively low strength alternately and in various manners in the cover 11, whereby a yielding material with high strength and toughness can be obtained through two compression processes.

According to the first embodiment as described above, two wooden sheets are first compressed separately (first compression process), and then the two compressed wooden sheets stacked are further compressed together (second compression process). Thus the wooden piece can be made thin in the first compression process to facilitate forming thereof.

Further, according to the first embodiment, two compression processes result in a production of a wooden piece where a layer with a higher strength and a layer with a lower strength are alternately stacked, and the strength of each layer is diverse, whereby a yielding compressed wood product with high strength and toughness can be provided.

Still further, according to the first embodiment, the direction of wooden fibers in the outer part of the cover is substantially perpendicular to the direction of wooden fibers in the inner part of the cover. Thus each of the outer part and the inner part can function as to supplement a lack of strength in the other part along the surface direction. Thus, non-uniformity of strength along the surface direction of the wooden piece can be eliminated, whereby uniform and suitable strength can be granted to the wooden piece.

Alternatively, contrary to the first embodiment, the direction of wooden fibers of the outer part 111 may be made substantially parallel with the breadthwise direction thereof, whereas the direction of wooden fibers of the inner part 112 may be made substantially parallel with the lengthwise direction thereof, so that the direction of wooden fibers of the outer part 111 is made substantially perpendicular to the direction of wooden fibers of the inner part 112.

Still alternatively, the directions of wooden fibers of two wooden pieces are not necessarily substantially perpendicular. In other words, as far as the directions of wooden fibers of two wooden pieces are arranged so as to intersect with each other, a similar advantage as in the first embodiment can be obtained. In this regard, the wooden piece cut out from the raw wood 50 does not necessarily have a straight grain surface.

Still alternatively, the directions of wooden fibers of the outer part and the inner part, and the shapes thereof may be opposite in the cover 11 and in the cover 12. For example, the cover 11 may be formed similarly as in the first embodiment, whereas the cover 12 is formed so that the direction of wooden fibers of the outer part 121 is substantially parallel with the breadthwise direction, whereas the direction of wooden fibers of the inner part 122 is substantially parallel with the lengthwise direction.

In the above description, two wooden sheets are placed one on another for the formation of the compressed wood product. The compressed wood product, however, can be formed from more than two wooden sheets. For example, when three wooden sheets with a straight grain surface are employed, three wooden sheets may be arranged so that the directions of wooden fibers thereof form angles of approximately 60 degrees with each other. Then, the wooden sheets can supplement lack of strength of each other as to improve the overall strength of the resulting product. In general, when n wooden sheets of straight grain surface (here, n is an integer not less than two) are employed, the wooden sheets are arranged so that wooden fibers thereof form angles of 180/n degrees with each other.

An example of suitable dimension is illustrated below for a cover made of two wooden sheets as a jacket for a small portable electronic device such as a digital camera. First, two planar wooden sheets are cut out so that the thickness R of each sheet is approximately 2 millimeters (mm), and compressed in the first compression process until each of the wooden sheets has a thickness of approximately 1.0 to 1.1 mm. In the subsequent second compression process, joined wooden sheets are compressed until a total thickness 2r thereof is approximately 1.6 to 1.8 mm.

Figure 16:
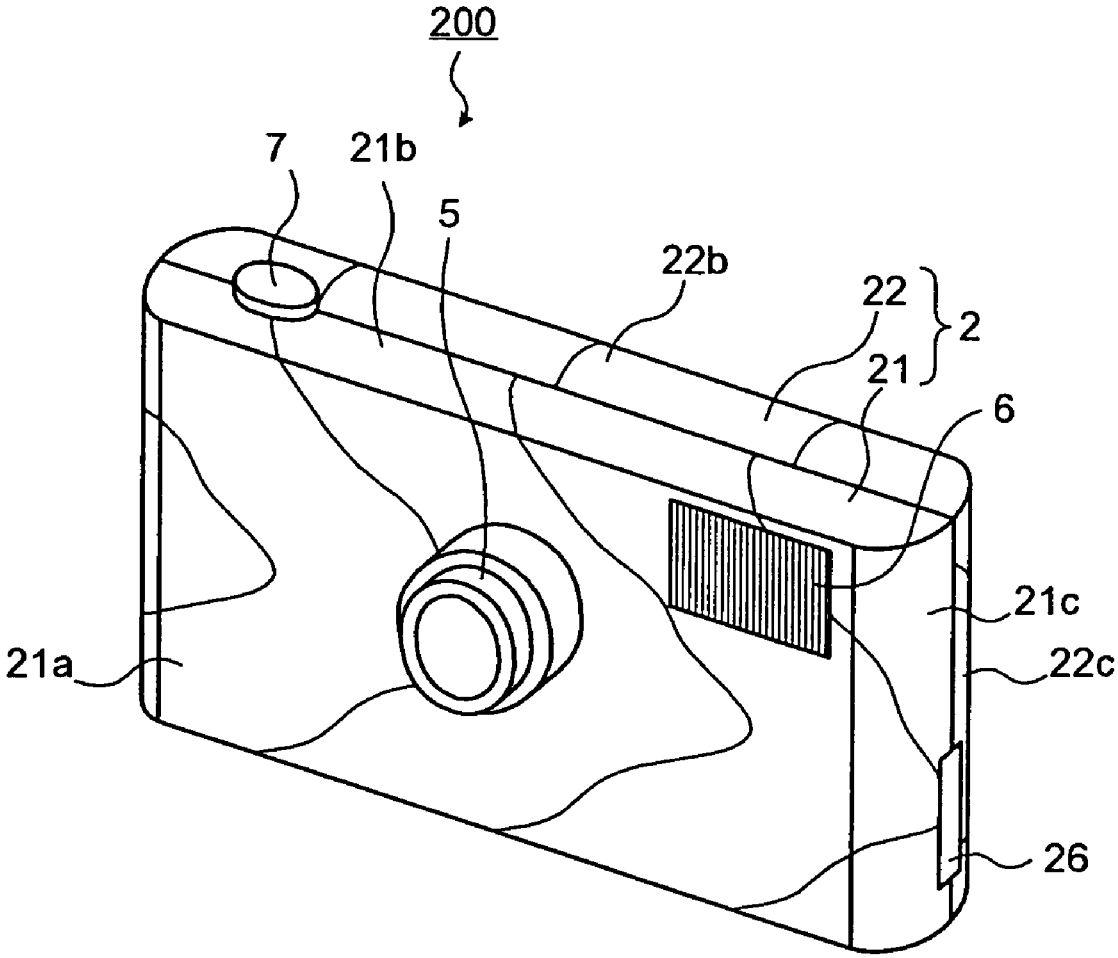
FIG. 16 is a perspective view of a structure of an electronic device whose jacket is made of a compressed wood product formed through a method of processing wood according to a second embodiment of the present invention.

FIG. 16 is a perspective view of a structure of an electronic device whose jacket is made of a compressed wood product formed through a method of processing wood according to a second embodiment of the present invention. The electronic device shown in FIG. 16 is a digital camera 200 which encloses various electronic elements inside the substantially rectangular solid jacket 2 formed from wooden covers 21 and 22 joined together, each formed like a bowl.

Figure 17:
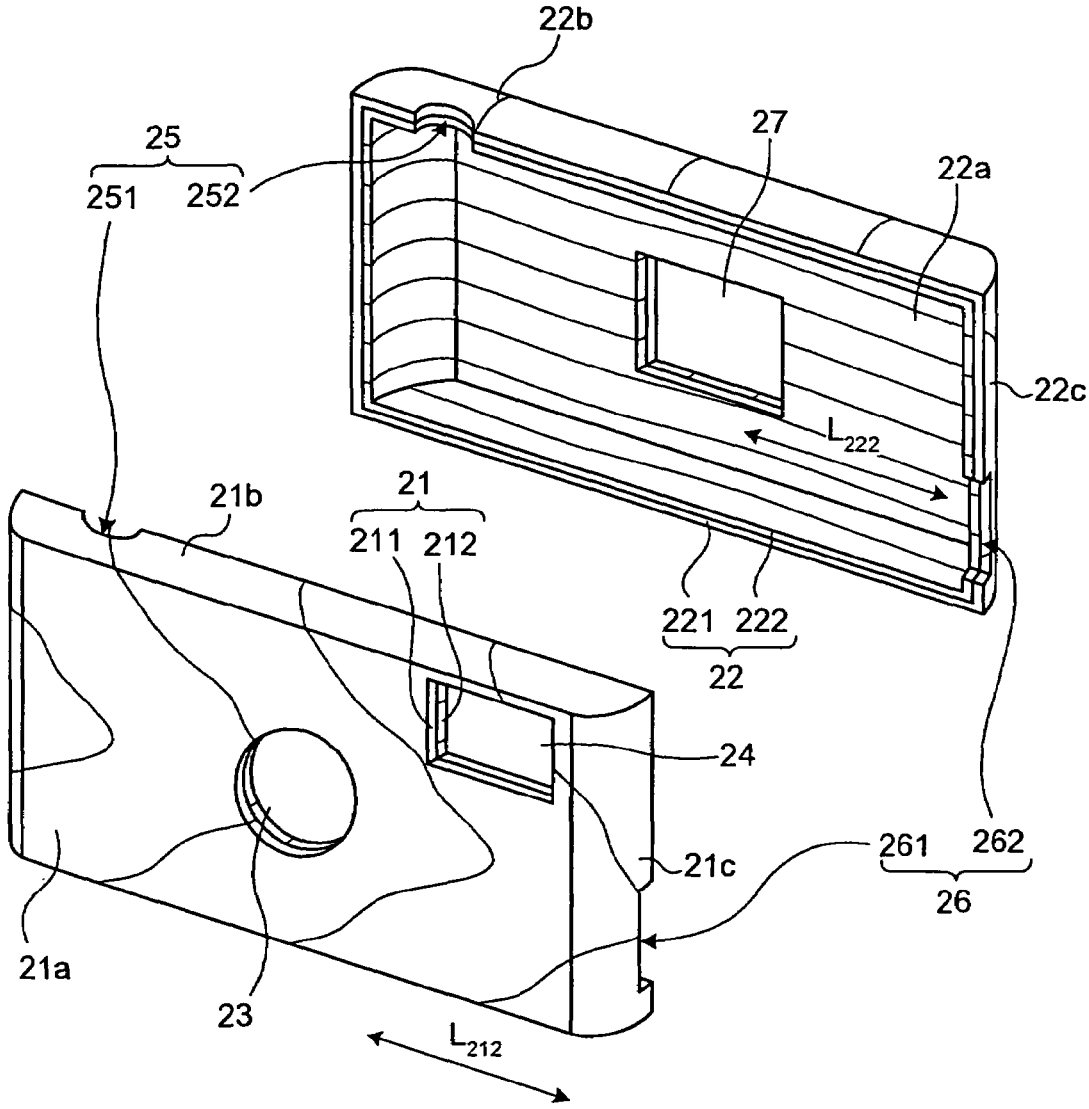
FIG. 17 is a perspective view of a structure of the compressed wood product formed through the method of processing wood according to the second embodiment.

FIG. 17 is a perspective view of a structure of the covers 21 and 22. The cover 21 includes a main plate 21*a* which has a substantially rectangular surface, two side plates 21*b* that extend from respective opposing longer sides of the main plate 21*a* in a direction substantially perpendicular to the main plate 21*a*, and two side plates 21*c* that extend from respective opposing shorter sides of the main pate 21*a* in a direction substantially perpendicular to the main plate 21*a*. The cover 22 is of substantially the same shape as the cover 21 and includes a main plate 22*a*, and side plates 22*b* and 22*c* that extend from a periphery of the main plate 22*a* at a predetermined angle.

The cover 21 is formed through a compression of two wooden sheets that are previously compressed separately and placed one on another, and includes two layers of an outer part 211 and an inner part 212. The cover 22 is formed similarly to the cover 21 and includes two layers of an outer part 221 and an inner part 222. In the second embodiment, the outer part and the inner part composing each cover have different grain pattern as indicated by 50 G. More specifically, the outer parts 211 and 221 have flat grain surfaces, whereas the inner parts 212 and 222 have straight grain surfaces.

As can be seen from FIG. 17, each of the outer parts 211 and 221 with a flat grain surface has a grain pattern where wooden fibers do not run in a uniform direction. On the other hand, in each of the inner parts 212 and 222 with a straight grain surface, directions $L_{212}$ and $L_{222}$ of wooden fibers are substantially parallel with the lengthwise directions of the covers 21 and 22, respectively. When the outer part has a flat grain surface, i.e., has a non-uniformly running pattern of wooden fibers, whereas the inner part has a straight grain surface, i.e., has a uniformly running pattern of wooden fibers, and such outer part and such inner part are placed one on another to form the covers 21 and 22, the directions of wooden fibers in the outer part and the inner part intersect with each other. As a result, anisotropy of the strength of each cover is decreased.

The main plate 21*a* of the cover 21 includes an opening 23 to expose the imaging unit 5 and an opening 24 for an attachment of the photoflash 6. The side plates 21*b* and 21*c* of the cover 21 have cut-out portions 251 and 261, respectively.

On the other hand, the main plate 22*a* of the cover 22 includes an opening 27 to expose the display unit 8 which is implemented by a liquid crystal display, a plasma display, an organic EL display or the like, and a protective member made of glass or the like is provided over the opening 27 to protect the display unit 8. The side plates 22*b* and 22*c* of the cover 22 include cut-out portions 252 and 262, respectively.

When the covers 21 and 22 with the above-described structures are joined together in an assembly of the digital camera 200, the cut-out portions 251 and 252 face with each other to form an opening 25, whereas the cut-out portions 261 and 262 face with each other to form an opening 26. The opening 25 exposes the shutter button 7, whereas the opening 26 exposes a connection device for connecting to an external device such as a personal computer. A cap may be provided to the opening 26 for protection of the connection device not in use.

The digital camera 200 has a similar internal structure as the digital camera 100 described above (see FIG. 3). Specifically, the jacket 2 houses at least a part of electronic elements which realize electronic functions such as imaging processing of the digital camera 200, and more particularly, houses the control unit 9. A structure, a manner of assembly or the like of the jacket 2 are the same as the structure, the manner of assembly or the like of the jacket 1 according to the first embodiment described above, respectively.

Figure 18:
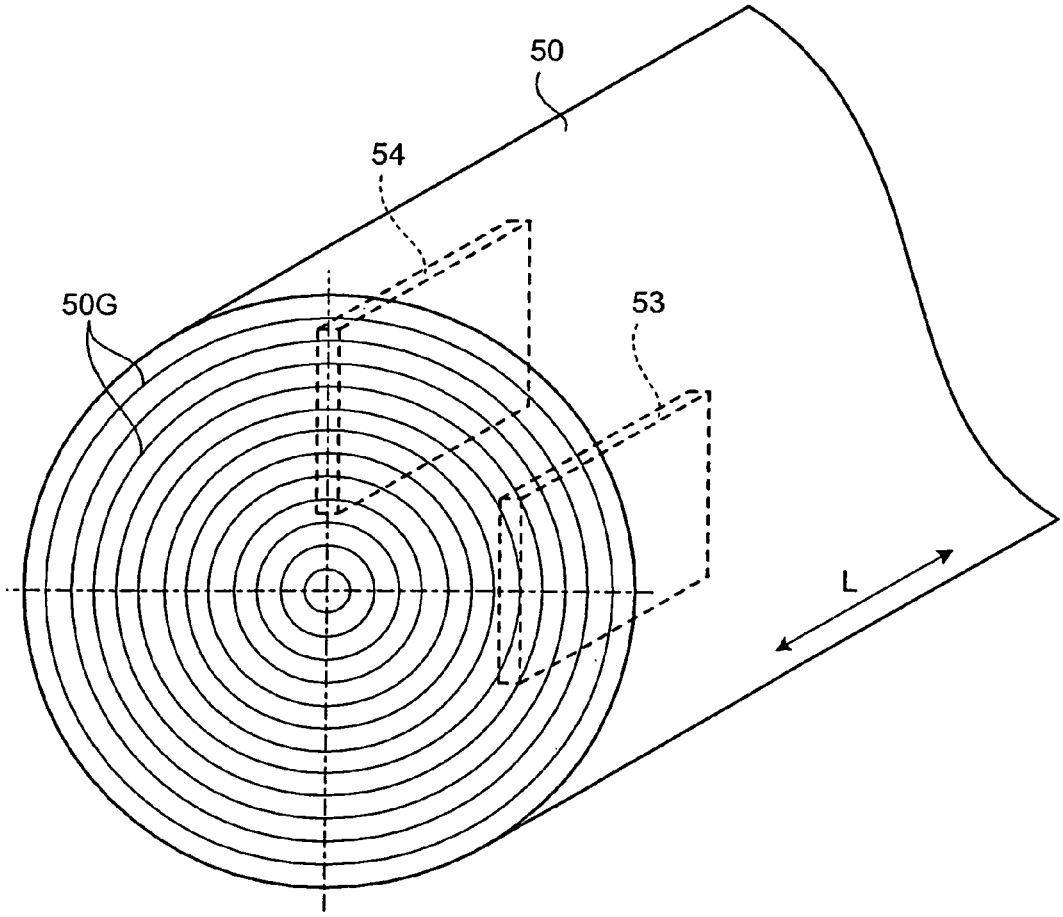
FIG. 18 is an explanatory diagram schematically showing how a wooden piece from which the compressed wood product is formed through the method of processing wood according to the second embodiment is cut out from raw wood.
Figure 19:
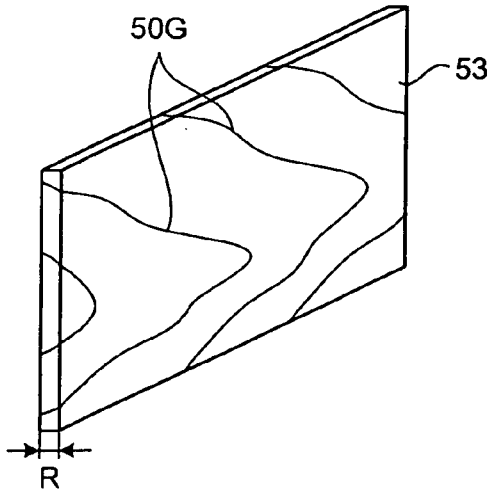
FIG. 19 is a perspective view of a structure of a wooden piece which is processed into an outer part of the compressed wood product formed through the method of processing wood according to the second embodiment.

Next, a method of processing the cover into the above-described structure is described in detail. First, wooden pieces are cut out from raw wood as material for the covers 21 and 22, so that the cut-out wooden pieces are larger than finished pieces by an amount to be decreased by the compression. FIG. 18 is an explanatory diagram which schematically shows shaping of the wooden pieces, which are materials for the covers 21 and 22, from the uncompressed raw wood 50. A wooden piece 53, which is a material for the outer part 211 or 221, is a planar sheet and cut out from the raw wood 50 so that a lengthwise direction of the wooden piece 53 is substantially parallel with the direction L of wooden fibers of the raw wood 50. The wooden piece 53 thus obtained has a flat grain surface (see FIG. 19).

On the other hand, a wooden piece 54, which is a material for the inner part 212 or 222, is cut out from the raw wood 50 so that the lengthwise direction thereof is substantially parallel with the direction L of wooden fibers of the raw wood 50, and has a straight grain surface. The wooden piece 54 has the same structure as the wooden piece 51 shown in FIG. 5. The thicknesses of the wooden pieces 53 and 54 are the same and represented as R. The wooden piece 53 is longer than the wooden piece 54 in the lengthwise direction.

Then, the cut-out wooden pieces 53 and 54 are compressed (first compression process). In the first compression process, the wooden pieces 53 and 54 are left in a water vapor atmosphere of high temperature and high pressure for a predetermined period prior to the compression. Thereafter, the wooden pieces 53 and 54 that have absorbed the water in excess and been softened are each sandwiched and compressed by predetermined two metal molds.

Through the first compression process, the wooden pieces 53 and 54 are deformed to have substantially uniform thicknesses $r_3$ (<R) and $r_4$ (<R), respectively, over a whole area thereof. A compression rate $C_3=(R-r_3)/R$ of the wooden piece 53 and a compression rate $C_4=(R-r_4)/R$ of the wooden piece 54 are both approximately 0.3 to 0.6.

Figure 20:
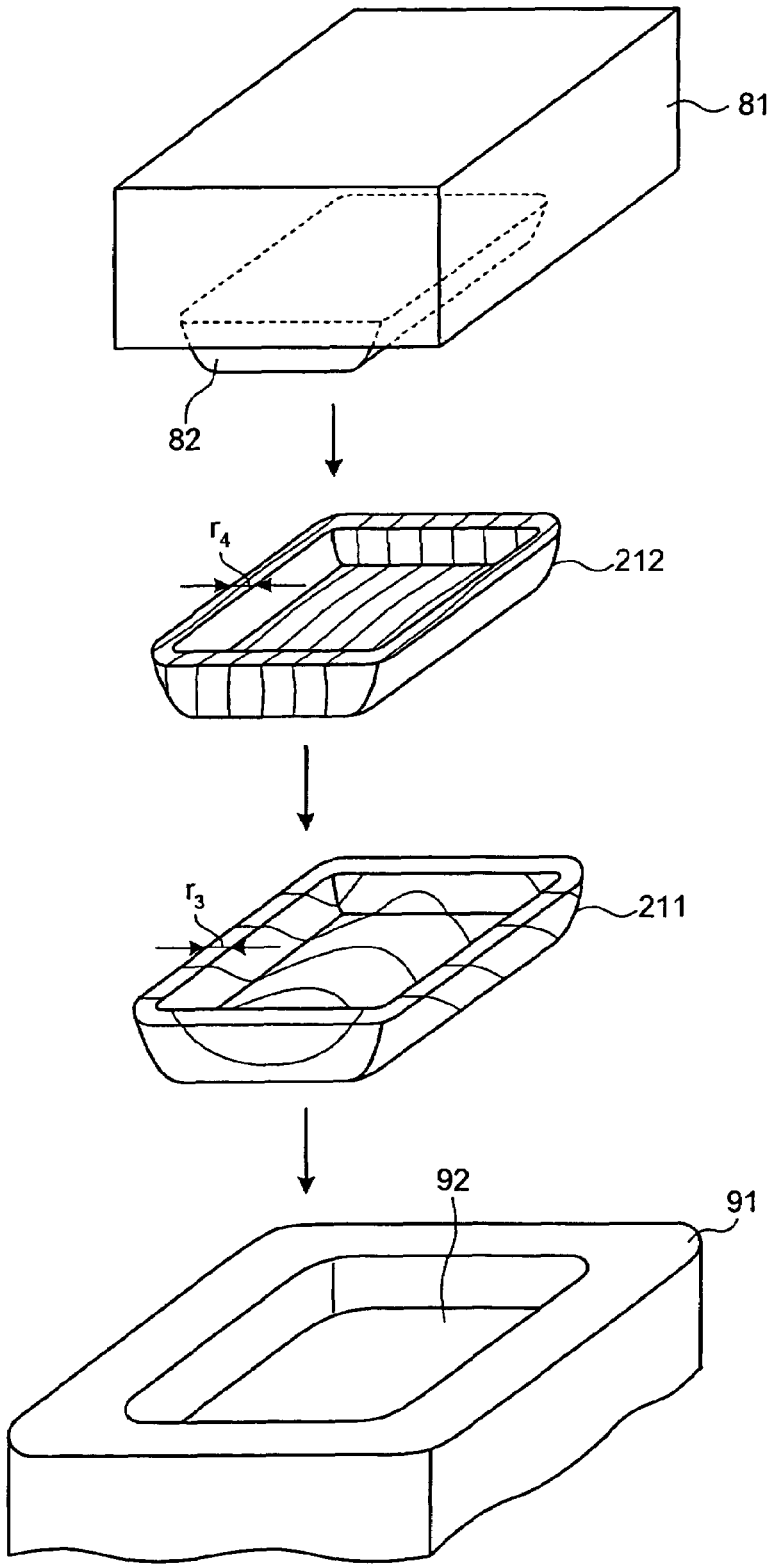
FIG. 20 is an explanatory diagram schematically showing how a wooden piece is processed in a second compression process of the method of processing wood according to the second embodiment.

FIG. 20 is an explanatory diagram schematically showing how the second compression process is carried out where the outer part 211 and the inner part 212 formed through separate compression of the respective wooden pieces 53 and 54 are placed one on another and compressed together. Hereinafter, the second compression process of the cover 21 is described. The cover 22 is also subjected to the same second compression process. In the second compression process, the inner part 212 is placed over the outer part 211 in the same water vapor atmosphere of high temperature and high pressure as in the first compression process, and two parts 211 and 212 are placed at a predetermined location between the metal molds 81 and 91. Then, two metal molds sandwich and compress the outer part 211 and the inner part 212 to deform the same into a predetermined shape.

Thereafter, the outer part 211 and the inner part 212 are released from the compression and dried whereby an original form of the cover 21 is obtained. As a result, the thickness of the cover 21 becomes approximately 30% to 50% of the total thickness 2R of the two wooden pieces before compression. Therefore, a compression rate through two compression processes is approximately 0.5 to 0.7, which is slightly larger than the compression rate (approximately 0.3 to 0.6) in the first compression process.

Thereafter, with the formation of an opening, a cut-out portion or the like in the compressed cover 21 in a predetermined position via cutting or punching, the cover 21 is finished. When the finished cover 21 has an unnecessary portion on an outer periphery thereof, such portion is removed via cutting and a suitable processing is performed on a resulting surface.

Thus, the second embodiment of the present invention realizes the same advantages as in the first embodiment. According to the second embodiment as described above, two wooden sheets are compressed separately (first compression process), and then the two compressed wooden sheets stacked are compressed together (second compression process). Thus the wooden piece can be made thin in the first compression process to facilitate forming thereof.

Further, according to the second embodiment, two compression processes result in a production of a wooden piece including a layer with a higher strength and a layer with a lower strength alternately stacked, and the strength of each layer is diverse (see FIG. 15), whereby a yielding compressed wood product is granted with a suitable and uniform strength, and a compressed wood product with high strength and toughness can be provided.

Still further, according to the second embodiment, the grain patterns of the outer part and the inner part constituting the cover are made different so that the directions of wooden fibers in the outer part and the inner part intersect with each other as to supplement lack of strength in weak positions of each other along the surface direction. As a result, the non-uniformity of strength in the surface direction of the wooden piece can be eliminated.

Thus, in the second embodiment, the wooden piece with a flat grain surface and the wooden piece with a straight grain surface are employed as the outer part and the inner part, respectively. Such selection of grain patterns is preferable in the following regards. First, the flat grain pattern, though categorized as such, shows different patterns in each wooden piece. When the flat-grain wooden piece is employed as an outer part of the product, the grain pattern can be a part of the product design and each product can show more notable and unique individual feature. Secondly, the straight-grain wooden piece tends to have a lower anisotropy and the direction of wooden fibers thereof is uniform. Hence, such wooden piece is strong against a force applied in a perpendicular direction to the direction of wooden fibers, and easily bent along the fiber direction for processing. Thus, the combination of the flat-grain wooden piece and the straight-grain wooden piece allows for the manufacturing of a compressed wood product with the advantages of both.

Alternatively, a wooden piece with an end grain surface can be employed as the outer part, or a wooden piece with grain pattern other than the straight grain pattern, e.g., an intermediate grain pattern of the straight grain and the flat grain, may be employed as the inner part. In particular, the flat grain wooden piece and the end grain wooden piece are relatively soft and contain relatively high sap components. Thus, the use of such wooden pieces brings about an additional advantage of easy bonding of the wooden piece with other part in the product in the second compression process.

In the second embodiment, similarly to the first embodiment, the compressed wood product may be manufactured from more than two wooden pieces. As mentioned above, the flat grain wooden piece and the end grain wooden piece are unique in design thereof. When the flat grain wooden piece or the end grain wooden piece, for example, is employed as the outer part, while two straight grain wooden pieces are employed as the inner parts and each superimposed on the outer part so that the directions of wooden fibers of the two straight grain wooden pieces are substantially perpendicular to each other and subjected to the second compression process, a resulting compressed wood product can enjoy suitable strength as well as excellence in design. Here, the flat grain wooden piece or the end grain wooden piece may be thinner than each of the other two straight grain wooden pieces when being taken out from the raw wood.

Figure 21:
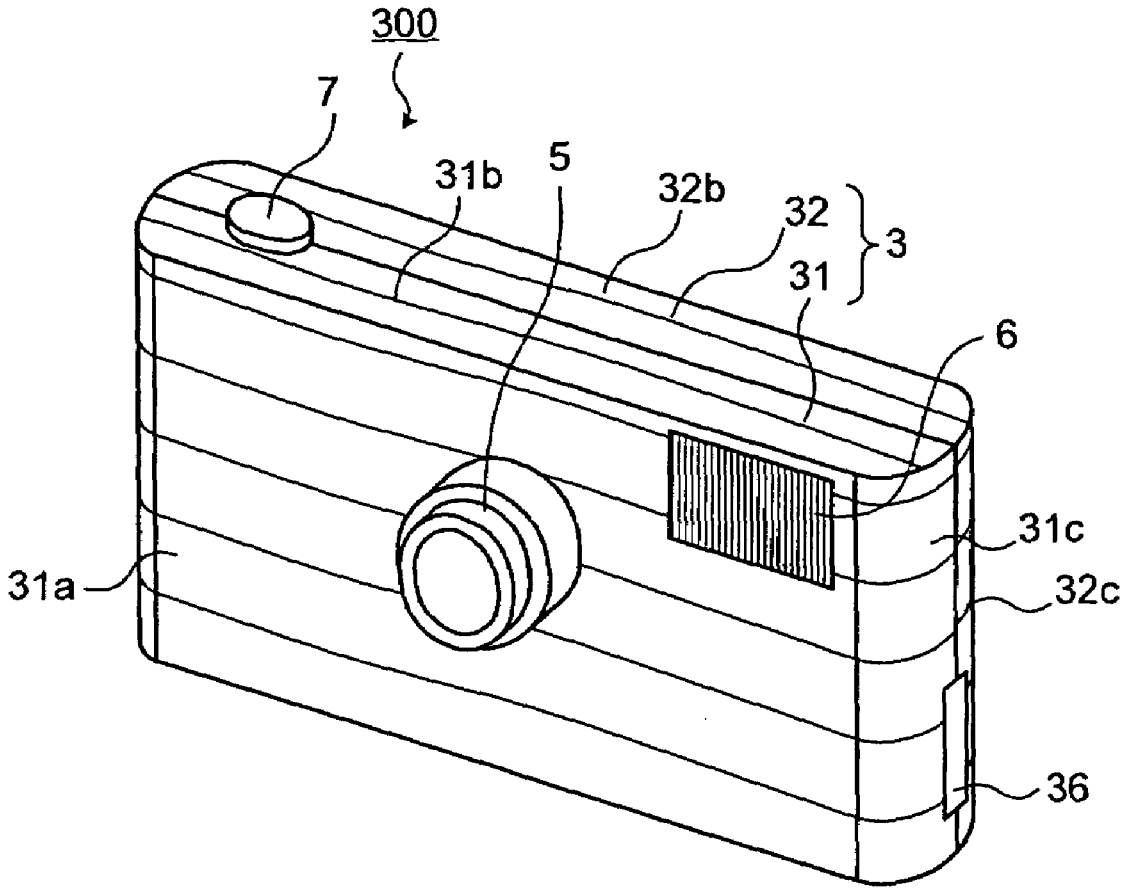
FIG. 21 is a perspective view of a structure of an electronic device whose jacket is made of a compressed wood product formed through a method of processing wood according to a third embodiment of the present invention.

FIG. 21 is a perspective view of a structure of an electronic device whose jacket is made of a compressed wood product formed through a method of processing wood according to a third embodiment of the present invention. The electronic device shown in FIG. 21 is a digital camera 300 which encloses various electronic elements inside a substantially rectangular solid jacket 3 formed from wooden covers 31 and 32 joined together, each formed like a bowl.

Figure 22:
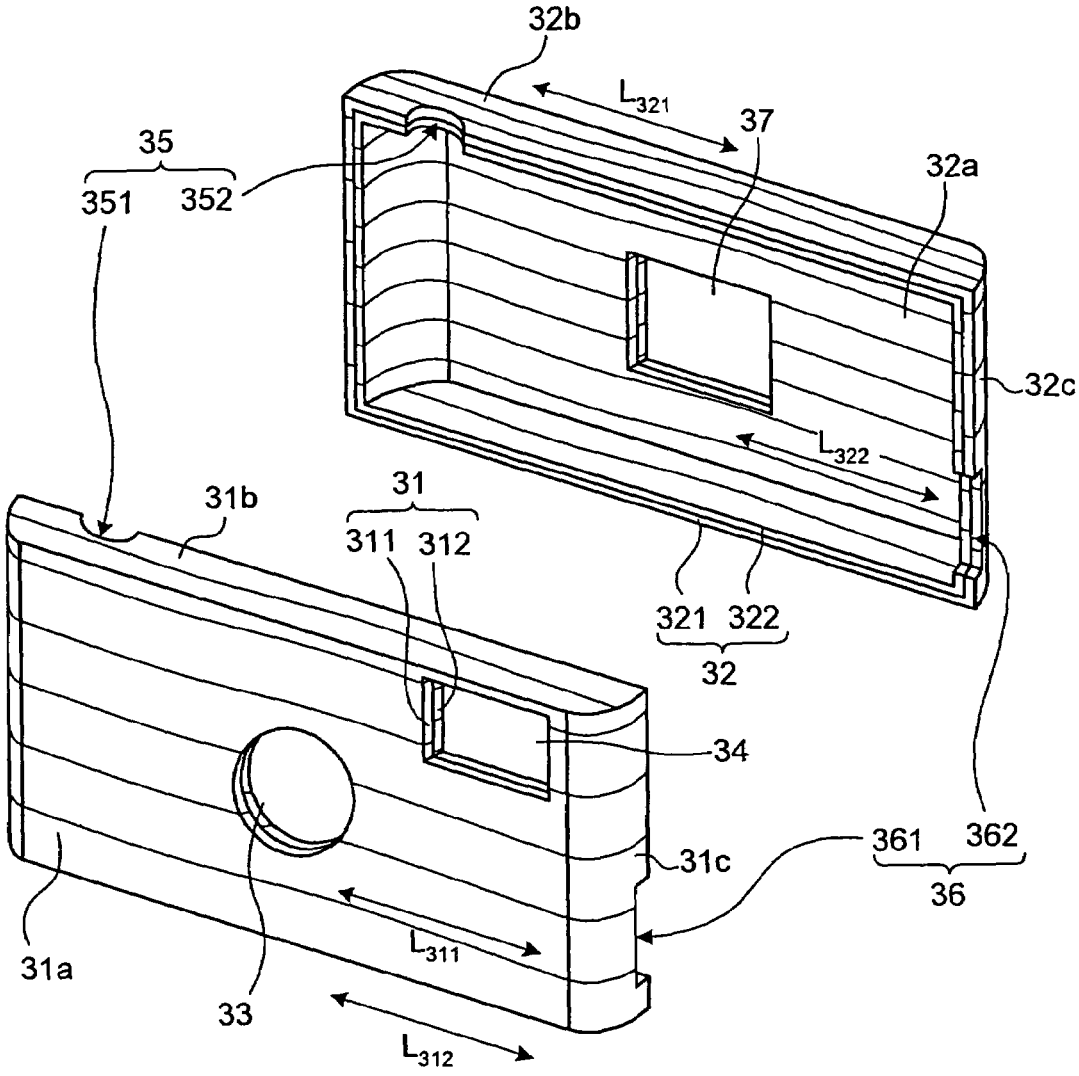
FIG. 22 is a perspective view of a structure of the compressed wood product formed through the method of processing wood according to the third embodiment.

FIG. 22 is a perspective view of a structure of the covers 31 and 32. The cover 31 includes a main plate 31*a* which has a substantially rectangular surface, two side plates 31*b* that extend from respective opposing longer sides of the main plate 31*a* in a direction substantially perpendicular to the main plate 31*a*, and two side plates 31*c* that extend from respective opposing shorter sides of the main pate 31*a* in a direction substantially perpendicular to the main plate 31*a*. The cover 32 is of substantially the same shape as the cover 31 and includes a main plate 32*a*, and side plates 32*b* and 32*c* that extend from a periphery of the main plate 32*a* at a predetermined angle.

The cover 31 is formed through a compression of two wooden sheets that are previously compressed separately and placed one on another, and includes two layers of an outer part 311 and an inner part 312. The cover 32 is formed similarly to the cover 31 and includes two layers of an outer part 321 and an inner part 322.

The outer parts 311, 321, and the inner parts 312, 322 are all straight grain wooden pieces. Among these wooden pieces, the directions of wooden fibers of the outer part 311 and the inner part 312 are substantially parallel with the lengthwise direction of the cover 31, and the grains 50 G of the outer part 311 and the inner part 312 placed one on another are substantially the same. Further, the directions of wooden fibers of the outer part 321 and the inner part 322 are substantially parallel with the lengthwise direction of the cover 32, and the grains 50 G of the outer part 321 and the inner part 322 placed one on another are substantially the same.

The main plate 31*a* of the cover 31 includes an opening 33 to expose the imaging unit 5 and an opening 34 for an attachment of the photoflash 6. The side plates 31*b* and 31*c* of the cover 31 have cut-out portions 351 and 361, respectively.

On the other hand, the main plate 32*a* of the cover 32 includes an opening 37 to expose the display unit 8 which is implemented by a liquid crystal display, a plasma display, an organic EL display or the like, and a protective member made of glass or the like is mounted over the opening 37 to protect the display unit 8. The side plates 32*b* and 32*c* of the cover 32 include cut-out portions 352 and 362, respectively.

When the covers 31 and 32 with the above-described structures are joined together in an assembly of the digital camera 300, the cut-out portions 351 and 352 face with each other to form an opening 35, whereas the cut-out portions 361 and 362 face with each other to form an opening 36. The opening 35 exposes the shutter button 7, whereas the opening 36 exposes a connection device for connecting to an external device such as a personal computer. A cap may be provided to the opening 36 for protection of the connection device not in use.

The digital camera 300 has a similar internal structure as the digital camera 100 described above (see FIG. 3). Specifically, the jacket 3 houses at least a part of electronic elements which realize electronic functions such as imaging processing of the digital camera 300, and more particularly, houses the control unit 9. A structure, a manner of assembly or the like of the jacket 3 are the same as the structure, the manner of assembly or the like of the jacket 1 according to the first embodiment described above, respectively.

Next, a method of processing the cover into the above-described structure is described in detail. First, wooden pieces are cut out from the uncompressed raw wood 50 as material for the covers 31 and 32, so that the cut-out wooden pieces are larger than finished pieces by an amount to be decreased by the compression.

Figure 23:
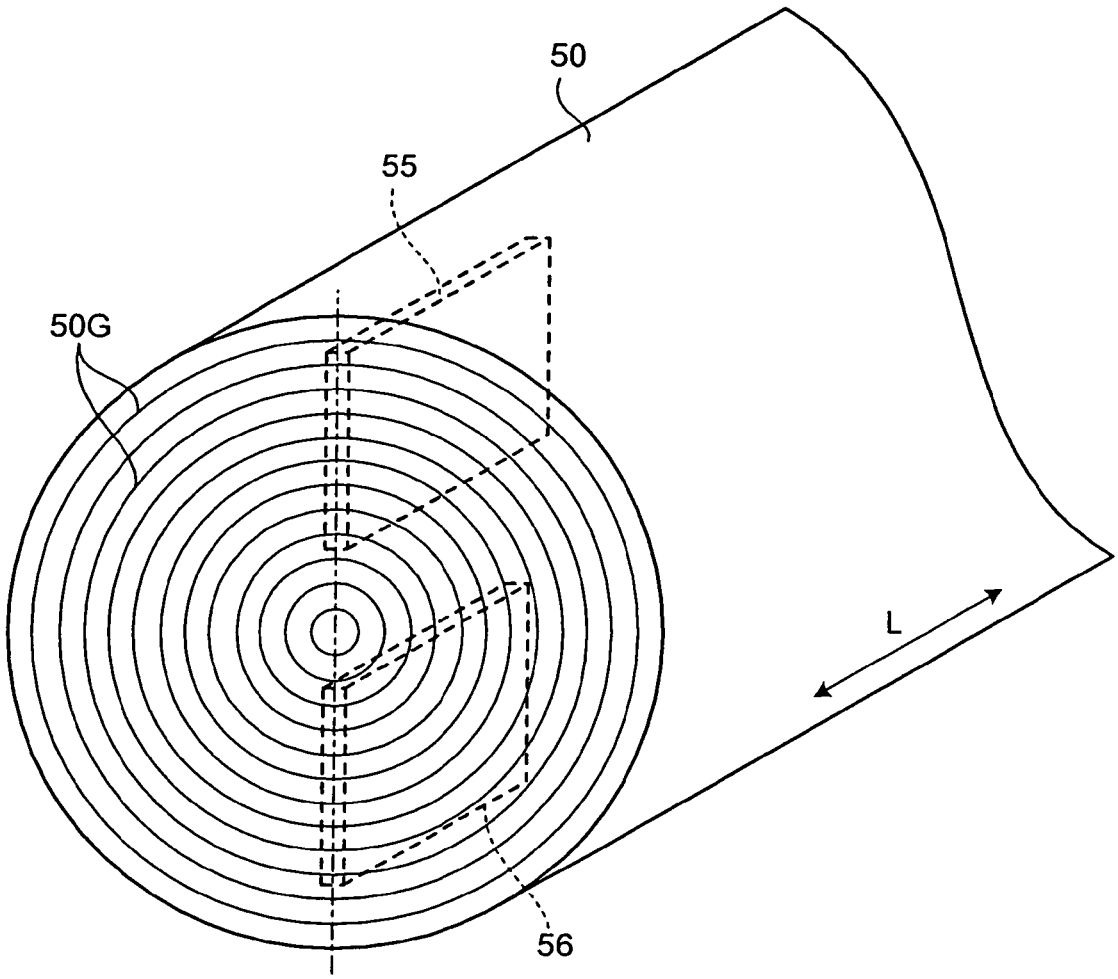
FIG. 23 is an explanatory diagram schematically showing how a wooden piece from which the compressed wood product is formed through the method of processing wood according to the third embodiment is cut out from raw wood.

FIG. 23 is an explanatory diagram which schematically shows shaping of the wooden pieces, which are materials for the cover 31 and 32, from the uncompressed raw wood 50. A wooden piece 55, which is a material for the outer part 311 or 321, is a planar sheet cut out from the raw wood 50 so that a lengthwise direction of the wooden piece 55 is substantially parallel with the direction L of wooden fibers of the raw wood 50, thereby exhibiting a straight grain pattern. A wooden piece 56, which is a material for the outer part 312 or 322, is a planar sheet and cut out from the raw wood 50 so that a lengthwise direction thereof is substantially parallel with the direction L of wooden fibers of the raw wood 50, thereby exhibiting a straight grain pattern. The thicknesses of the wooden pieces 55 and 56 are the same and represented as R. The wooden piece 55 is longer than the wooden piece 56 in the lengthwise direction.

Then, the cut-out wooden pieces 55 and 56 are compressed (first compression process). In the first compression process, the wooden pieces 55 and 56 are left in a water vapor atmosphere of high temperature and high pressure for a predetermined period prior to the compression. Thereafter, the wooden pieces 55 and 56 that have absorbed the water in excess and been softened are each sandwiched and compressed by predetermined two metal molds.

Through the first compression process, the wooden pieces 55 and 56 are deformed to have substantially uniform thicknesses $r_5$ (<R) and $r_6$ (<R), respectively, over a whole area thereof. In the third embodiment, the first compression process is carried out so that the thickness $r_5$ of the wooden piece 55 is equal to the thickness $r_6$ of the wooden piece 56. A compression rate $C_5=(R-r_5)/R$ of the wooden piece 55 and a compression rate $C_6=(R-r_6)/R$ of the wooden piece 56 are equal and both approximately 0.3 to 0.6.

Figure 24:
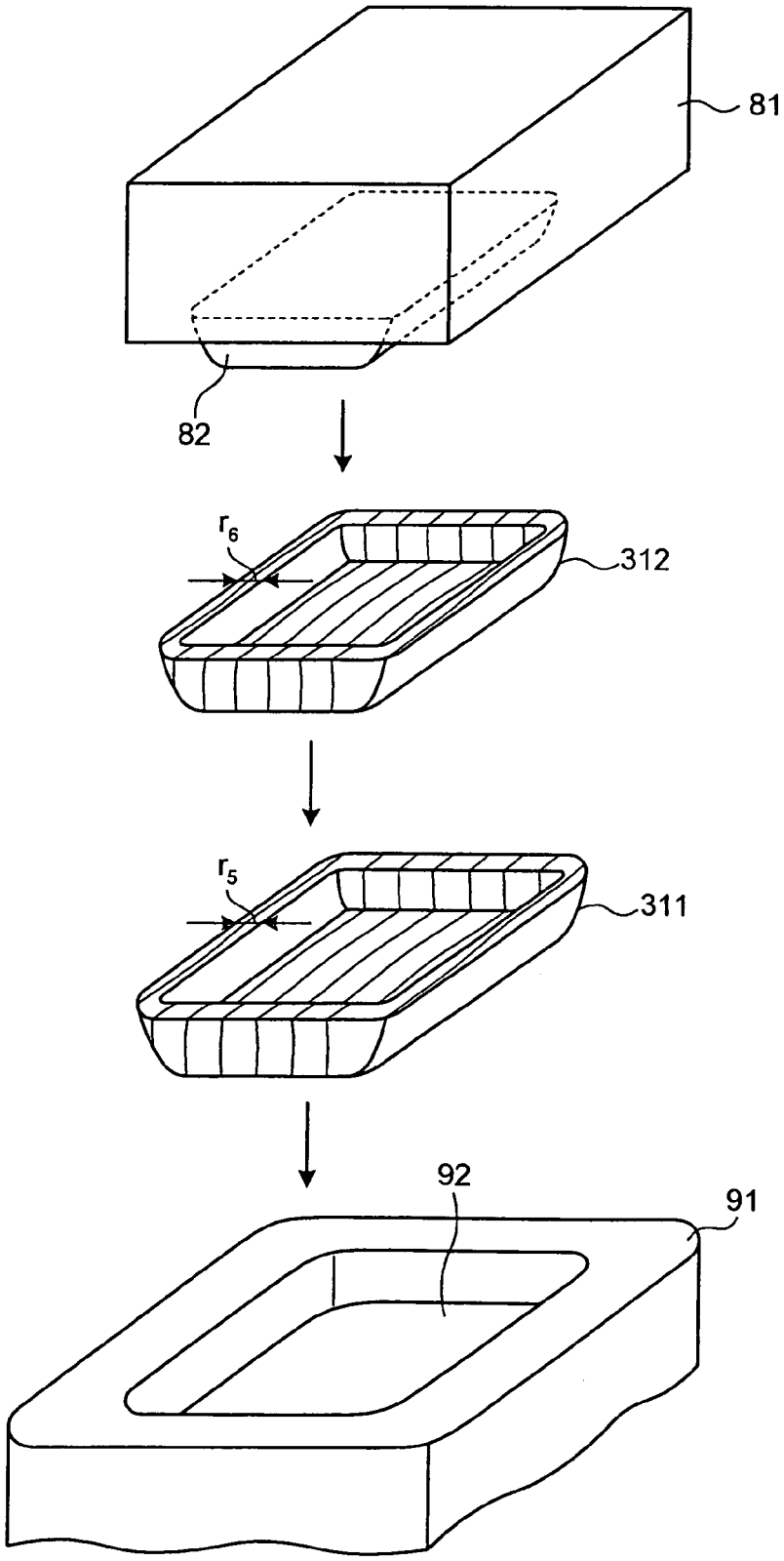
FIG. 24 is an explanatory diagram schematically showing how a wooden piece is processed in a second compression process of the method of processing wood according to the third embodiment.

FIG. 24 is an explanatory diagram schematically showing how the second compression process is carried out where the outer part 311 and the inner part 312 formed through separate compression of the respective wooden pieces 55 and 56 are placed one on another and compressed together. Hereinafter, the second compression process of the cover 31 is described. The cover 32 is also subjected to the same second compression process.

In the second compression process, the inner part 312 is placed over the outer part 311 in the same water vapor atmosphere of high temperature and high pressure as in the first compression process, and two parts 311 and 312 are placed at a predetermined location between the metal molds 81 and 91. Then, two metal molds sandwich and compress the outer part 311 and the inner part 312 to deform the same into a predetermined shape.

Thereafter, the outer part 311 and the inner part 312 are released from the compression and dried whereby an original form of the cover 31 is obtained. As a result, the thickness of the cover 31 becomes approximately 30% to 50% of the total thickness 2R of the two wooden pieces before compression. Therefore, a compression rate through two compression processes is approximately 0.5 to 0.7, which is slightly larger than the compression rate (approximately 0.3 to 0.6) in the first compression process.

Thereafter, with the formation of an opening, a cut-out portion or the like in the compressed cover 31 in a predetermined position via cutting or punching, the cover 31 is finished. When the finished cover 31 has an unnecessary portion on an outer periphery thereof, such portion is removed via cutting and a suitable processing is performed on a resulting surface.

In the third embodiment, the grain patterns of the outer part and the inner part are generally substantially the same after the second compression process. Hence, the contraction and expansion of the jacket 3 caused by the application of external forces or the changes in temperature or humidity is substantially the same in the outer part and the inner part joined with each other. Therefore stress is not likely to be accumulated inside the outer and the inner parts. As a result, the product can enjoy a specific advantage that the strain is not likely to be caused even under the application of external forces or the changes in temperature or humidity.

Further, when the grain patterns of the outer part and the inner part are substantially the same, the resulting product can possess similar characteristics to a compressed wood product of a similar shape made of one wooden piece. On the other hand, though the direction of wooden fibers in the outer part and the direction of wooden fibers in the inner part are substantially parallel, the grain patterns of the outer and the inner parts after joined together do not completely match with each other. Hence, the compressed wood product made of plural parts as in the embodiments is allowed to have smaller anisotropy of strength and the strength thereof is more uniform compared with the compressed wood product made of one wood piece.

In the third embodiment, the employed wooden pieces are not necessarily straight grain wooden pieces as far as the grain patterns of the outer part and the inner part are substantially the same. Alternatively, the flat grain wooden piece, the end grain wooden piece, or the wooden piece with an intermediate grain pattern of the flat grain and the straight grain may be employed.

According to the third embodiment as described above, similarly to the above-described two embodiments, two wooden sheets are compressed separately (first compression process), and then the two compressed wooden sheets stacked are further compressed together (second compression process). Thus, similarly to the two embodiments described above, the wooden piece can be made thin in the first compression process to facilitate the forming thereof.

Further, according to the third embodiment, two compression processes result in a production of a wooden piece including a layer with a higher strength and a layer with a lower strength alternately stacked, and the strength of each layer is diverse (see FIG. 15), whereby a yielding compressed wood product with high strength and toughness can be provided.

Further, according to the third embodiment, the outer part and the inner part constituting the cover are placed one on another so that the grain patterns thereof substantially match and are fixed in the second compression process. Thus, fixed two parts expand/contract substantially in the same manner as to prevent accumulation of internal stress. Thus, strain is not easily caused even under the application of external forces or the change in temperature or humidity.

Further, according to the third embodiment, though the matching of the grain patterns grants the product a similar advantage found in the product made of one wooden piece, the grain patterns of the superimposed parts do not completely match. Hence, the anisotropy of the strength can be smaller and overall strength of the product can be more uniform compared with the compressed wood product made of one wooden piece.

Figure 25:
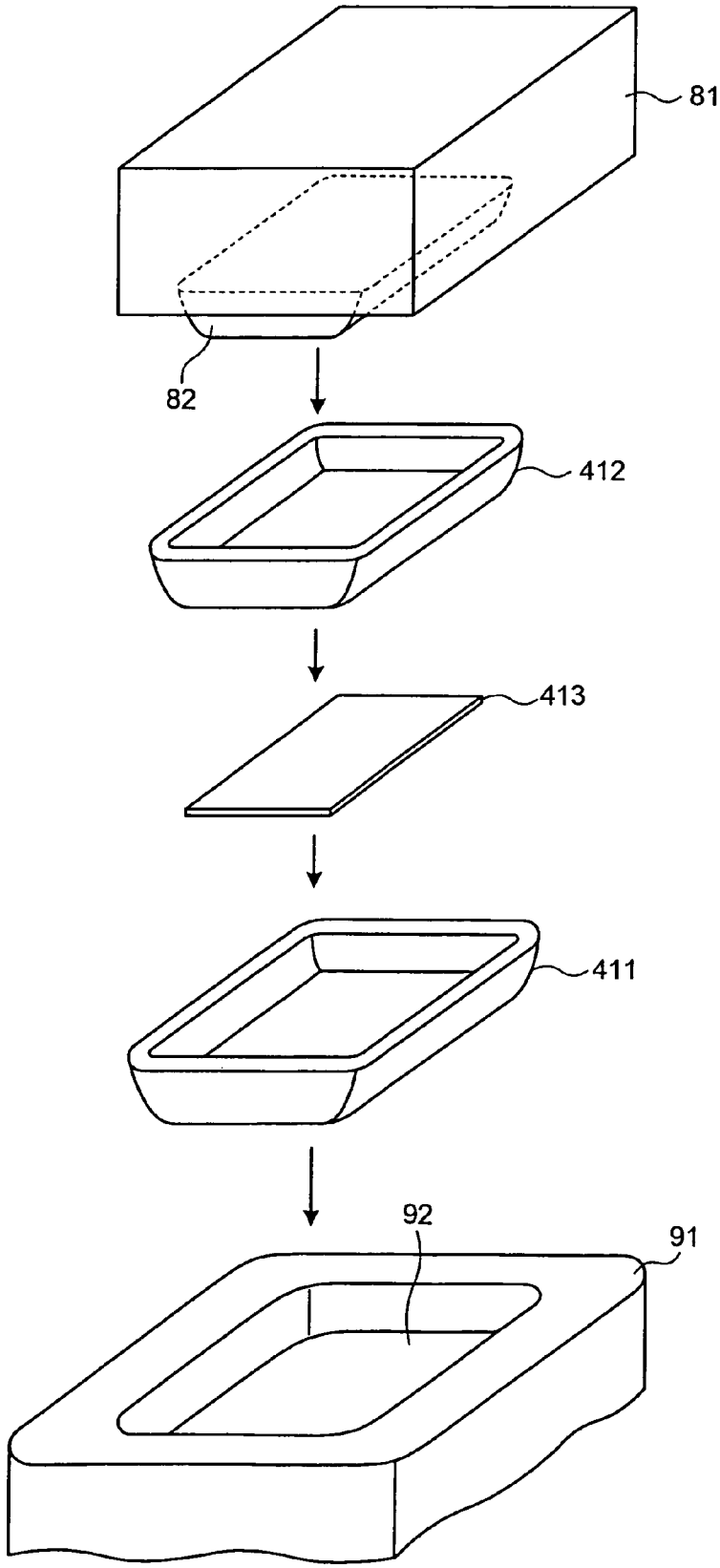
FIG. 25 is an explanatory diagram schematically showing how a wooden piece is processed in a second compression process of the method of processing wood according to a fourth embodiment of the present invention.

FIG. 25 is an explanatory view which schematically shows how a wooden piece is processed in a second compression process of a method of processing wood according to a fourth embodiment of the present invention. As shown in FIG. 25, the second compression process is performed on an outer part 411 and an inner part 412, subjected to the first compression process at the same compression rate, with a reinforcing member 413 interposed therebetween. The first compression process in which planar wooden pieces cut out from raw wood are separately compressed to be the outer part 411 and the inner part 412 is the same as the first to the third embodiments described above.

In FIG. 25, the grain pattern and the direction of wooden fibers are not clearly shown for the outer part 411 and the inner part 412, since the method of processing wood according to the fourth embodiment is employable regardless of the grain pattern or the direction of wooden fibers in the outer part 411 and the inner part 412.

The reinforcing member 413 is formed from natural fibers such as cotton, hemp, linen, including wooden fiber component such as cellulose, or regenerated cellulose fibers such as rayon. More specifically, the reinforcing member 413 is formed from a bunch of plural fibers that have a uniform thread-like shape and are arranged in a uniform direction in a high density. When the direction of fibers in such reinforcing member 413 is set to intersect with the direction of wooden fibers of the wooden piece, i.e., in a direction in which the wooden piece is weak, the bending strength as well as the tensile strength of the compressed wood product after the processing can be improved.

For example, if the outer part 411 and the inner part 412 are straight grain wooden pieces similar to the outer part 111 and the inner part 112 of the first embodiment, the direction of wooden fibers of the outer part 411 is arranged substantially parallel with the lengthwise direction of the cover 41 and the direction of wooden fibers of the inner part 412 is arranged substantially parallel with the breadthwise direction of the cover 41. Thus, if the reinforcing member 413 is arranged between the outer part 411 and the inner part 412 so that the direction of fibers therein forms an angle of 45 degrees with both the direction of wooden fibers of the outer part 411 and that of the inner part 412, the reinforcing member 413 can function to strengthen the resulting product, in which the outer part 411 and the inner part 412 are superimposed, in a direction in which the strength is relatively weak.

Figure 26:
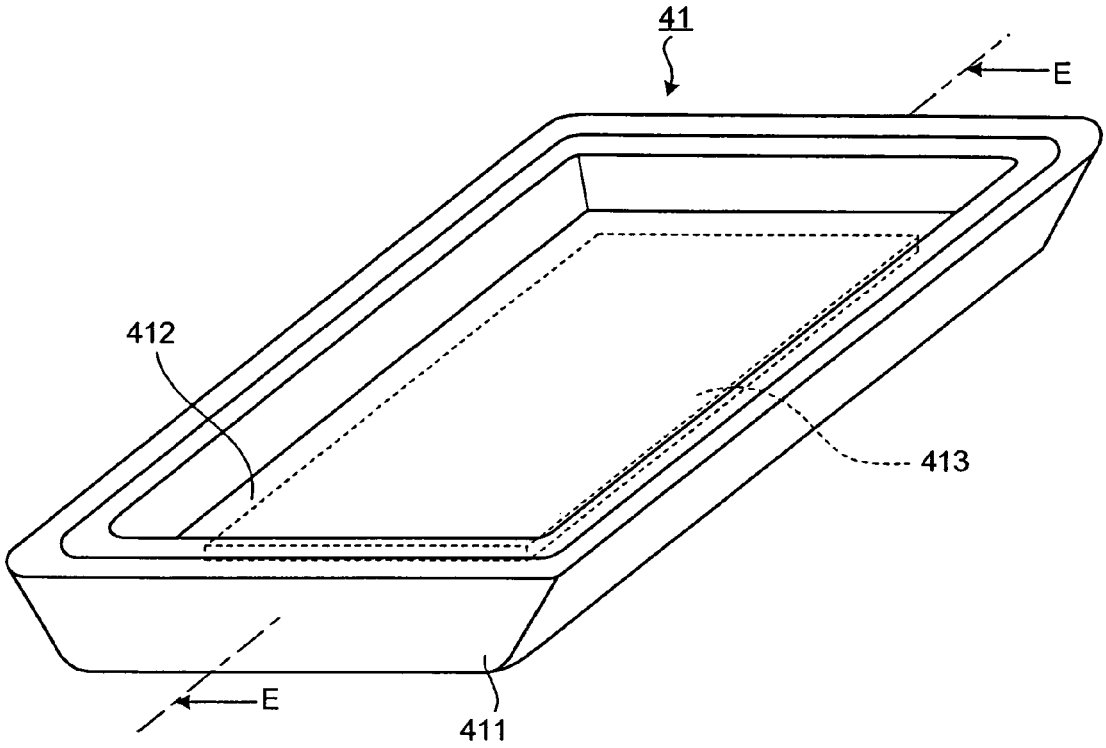
FIG. 26 is a perspective view of a structure of the compressed wood product formed through the method of processing wood according to the fourth embodiment.
Figure 27:
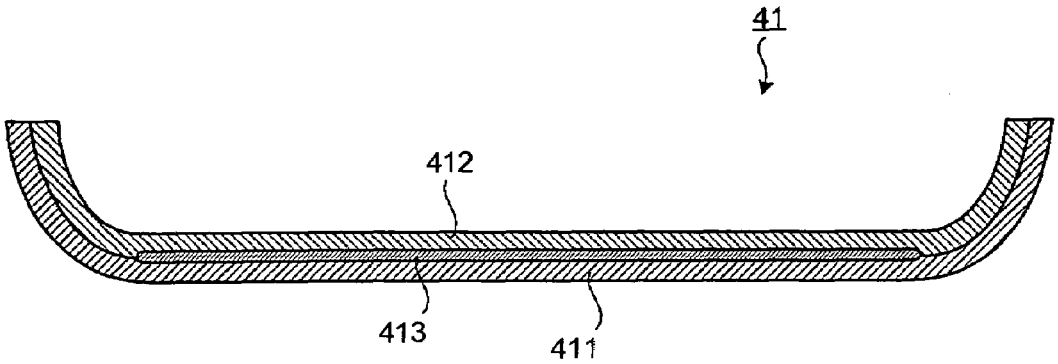
FIG. 27 is a sectional view of the compressed wood product along a line E-E shown in FIG. 26.

FIG. 26 is a perspective view of a structure of the finished cover 41 after the second compression process followed by the release of compression and drying, and FIG. 27 is a sectional view of the cover 41 along a line E-E of FIG. 26. As shown in FIGS. 26 and 27, the reinforcing member 413, after compressed between the outer part 411 and the inner part 412, partly bites into the surfaces of the outer part 411 and the inner part 412. The reinforcing member 413 is, however, mainly formed from a component contained in wood and hence has a high affinity with wood. As a result, the reinforcing member 413, without damaging the wooden fiber by cutting or the like, is fixed to the surface of the wooden piece in a conforming state.

In addition, under the application of external forces or the changes in temperature or humidity, the reinforcing member 413 is deformed following the deformation of the cover 41, thereby preventing an excessive deformation of the cover 41. This is because the reinforcing member 413 is mainly formed from the component contained in the wood, and Young's modulus, thermal expansion coefficient, and coefficient of moisture expansion of the reinforcing member 413 are close to Young's modulus, thermal expansion coefficient, and coefficient of moisture expansion of the cover 41, respectively.

Here, the direction of wooden fibers of the reinforcing member 413 is not necessarily be uniformly aligned, and may be at random. Still alternatively, the reinforcing member 413 may be formed from fibers knitted like netting. In addition, the length of each fiber is not necessarily be uniform, and the reinforcing member 413 may be formed from an extremely thin fabric made of silk or hemp, unwoven fabric, or the like.

The material for the reinforcing member 413 is not limited to what containing a wooden fiber component. For example, carbon fibers may be applicable as the reinforcing member 413, and a suitable material to which predetermined fabrics are pasted may be employed as the reinforcing member 413. Still alternatively, the reinforcing member 413 may be formed from a metal sheet or metal netting.

The cover 41 formed as described above, in combination with another cover (not shown) which is formed similarly to the cover 41, constitutes a jacket of an electronic device. A structure and a method of assembly or the like of the jacket for the electronic device, for example, for a digital camera are the same as the structure and the method of assembly or the like of the jacket 1 for the digital camera 100 according to the first embodiment, respectively, except for the presence of the reinforcing member 413 in the former (see FIGS. 1 to 3).

According to the fourth embodiment of the present invention as described above, a compressed wood product can be readily formed and a suitable strength can be provided over a whole area thereof through the two compression processes.

In addition, according to the fourth embodiment, with the reinforcing member arranged between the outer part and the inner part of the cover (compressed wood product), the strength of the cover can be further improved.

In particular, with the use of the reinforcing member containing wooden fiber component, contraction rate of the reinforcing member is substantially the same as contraction rate of the wooden pieces. Thus, the reinforcing member has a high affinity with wood and quality of product material can be homogenized. Still further, the reinforcing member containing wooden fiber component does not cut into the wooden fibers of the wooden piece itself, thereby further improving the strength of the cover as the compressed wood product without degrading the strength of the wooden piece itself.

Here, the reinforcing member may be applied to one or both of the outer surface of the outer part and the inner surface of the inner part. When the reinforcing member is to be provided on the outer surface of the outer part, the reinforcing member serves as a part of design of the product to further enhance the unique quality of the product, as well as contributing to improve the strength of the compressed wood product. On the other hand, when the reinforcing member is provided on the inner surface of the inner part, the strength of the compressed wood product can be improved without any influence on an appearance thereof.

When more than two wooden pieces are employed for the manufacturing of the compressed wood product, the reinforcing member may be arranged between at least one pair of adjacent wooden pieces.

Though the exemplary embodiments of the present invention are described above in details as the first to the fourth embodiments, the present invention is not limited to the embodiments described above. Other embodiments of the present invention will be described below.

(1) An electronically functioning element may be arranged between the outer part and the inner part of the cover. For example, a ground circuit board may be arranged between the outer part and the inner part so that the ground circuit can be connected to the electronic element housed in the jacket. Then, a space for the ground circuit, which may be usually set inside the jacket, is not necessary and hence the space saving is allowed. Further, a metal sheet may be provided between the outer part and the inner part. The metal sheet, in addition to functioning as a reinforcing member, serves as a shielding material to protect the product from electromagnetic waves. Still further, a sheet, a flexible substrate or the like in which an IC chip or various mounted elements are built may be provided between the outer part and the inner part. Then, various functions can be realized in a manufactured electronic device.

When the cover is formed from more than two wooden pieces, the reinforcing member and the electronically functioning element can be arranged at various positions. Such elements may be arranged in combination depending on the use of the cover.

Figure 28:
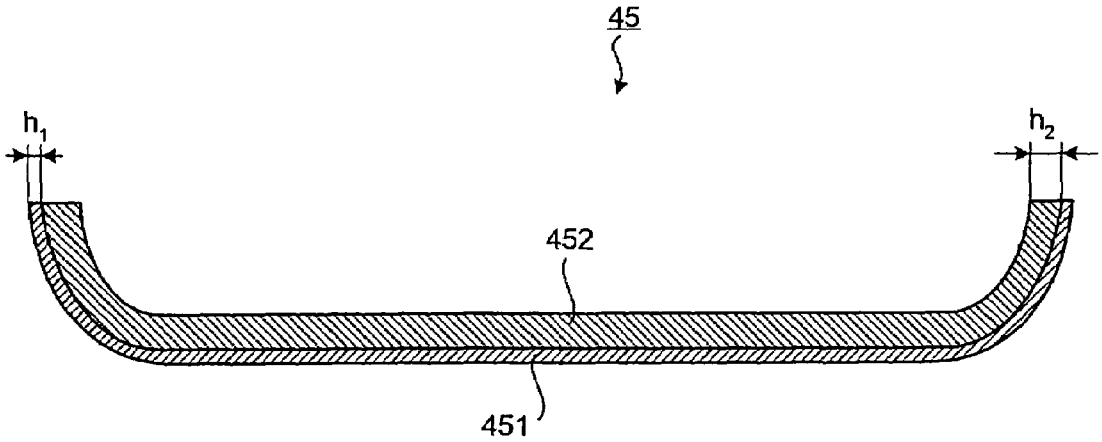
FIG. 28 is a sectional view of a structure of a compressed wood product formed from an outer part and an inner part with different thicknesses.

(2) FIG. 28 is a sectional view of a structure of the cover made of a compressed wood product of which outer part and inner part have different thicknesses. The compression rates for an outer part 451 and an inner part 452 are the same in the first and the second compression processes. As shown in FIG. 28, a cover 45 has the outer part 451 with thickness $h_1$ which is smaller than thickness $h_2$ of the inner part 452 ($h_1<h_2$). Since the outer part 451 is relatively thin, a wooden piece which easily cracks and is difficult to form is employable as a material. For example, a flat grain wooden piece or an end grain wooden piece can be employed for the outer part 451. Thus, with the use of a thin wooden piece, the first compression process is simplified and damages such as cracks in the wooden piece can be prevented.

On the other hand, with the use of a wooden piece such as a straight grain wooden piece with higher strength as the inner part, the strength of the cover 45 as a whole can be improved by an amount of increase in the thickness of a part with higher strength, though the entire thickness of the cover itself does not change. When a plate-like wooden piece is subjected to the processing such as bending, and the degree of deformation is different for the outer part and for the inner part in the first compression process, the part with a higher degree of deformation may be set thinner than the easily deformable part.

(3) Through the adjustment of the thickness of the wooden piece and the shape of the metal mold employed in the first compression process, the compression rate for the outer part and the inner part may be changed for each part. The color tone of the wooden pieces taken from the same species of wood after the compression varies according to the compression rates. More specifically, the higher the compression rate, the more the carbonization of the wooden piece advances to darken the surface color. In addition, the wooden piece subjected to compression at relatively higher compression rate exhibits improved surface smoothness and gloss and is more resistant to stain.

Contrarily, the wooden piece subjected to compression with relatively lower compression rate is softer, though exhibits a smaller change in surface color compared with the wooden piece with relatively higher compression rate. In addition, the wooden piece subjected to compression with relatively lower compression rate keeps more wood-like texture and feels nice. If the compression rate of the wooden piece is set according to the design or the characteristic of a product to be manufactured in view of the above-mentioned features, unique compressed wood products with various color tones can be manufactured.

For example, the compression rate for the end-grain wooden piece may be set low since the end-grain wooden piece is difficult to form via bending or the like, whereas the compression rate for the straight-grain wooden piece may be set high since the straight-grain wooden piece is easy to form. Then, a compressed wood product can be easily formed from these wooden pieces stacked and compressed together. Thus, with a combination of wooden pieces subjected to compression with different compression rates, suitable strength can be guaranteed along with the provision of a wide variety of color tones and appearance of the products.

When the compression rate of the wooden piece is set sufficiently high within the range of below limiting compression rate of the wooden piece, the compression brings about not only the change in color tone but carbonization of the wooden piece through burning by the heated metal molds, which turns the wood material into a conductor that functions as an electromagnetic shield. Hence, when the compressed wood product is to be manufactured via the method of processing wood according to the present invention so as to be employed as a jacket for an electronic device, preferably one wooden piece is turned into a conductor by the high compression rate and another wooden piece is made to remain an insulator without carbonization, and the wooden pieces with different characteristics may be placed one on another to form the jacket. For the manufacture of such compressed wood product, at least one of a surface of the outer part and a surface of the inner part facing with each other in the finished product may be carbonized in the first compression process.

Here, since one wooden piece is carbonized, joining of the wooden pieces is not achievable only with sap components. Hence, adhesive is necessary for joining of wooden pieces.

(4) In the above description, it is assumed that the all wooden pieces are taken out from the same species of wood. However, the wood species may differ for different parts. For example, when the cover for an electronic device is formed with two wooden pieces placed one on another, a species of wood which looks particularly good may be employed as the outer part to improve design property, whereas a strong species of wood is employed as the inner part with the focus on a higher strength. When a combination of wooden pieces taken out from different species of wood is well utilized and processed, a resulting compressed wood product may possess both strength and appearance which cannot be obtained if the wood pieces taken out from one wood species are only employed.

Here, the thickness and the compression rate of each part can be adjusted similarly as described above according to the degree of difficulty of processing of wood employed as the outer part and the inner part.

(5) With the adjustment of the shape of the metal mold, the advantages of both the first compression process and the second compression process is fully utilized in the processing. More specifically, since each wooden piece is thinner and thus easier to form at the time of the first compression process, the wooden pieces are processed nearly to the finished shape in the first compression process. On the other hand, the degree of deformation in the second compression process is set smaller than in the first compression process. In the second compression process, the wooden pieces may be compressed slightly in the thickness direction. However, the second compression is mainly dedicated to processing that requires high alignment accuracy. For example, joining of wooden pieces, carving of a name of manufacturer or a product name, carving for design purpose, or the like are performed in the second compression process. Thus, when two separate compression processes are fully utilized, highly accurate forming of the wooden piece is allowed.

(6) The wooden piece may be cut out from the raw wood so as to be in a predetermined three-dimensional shape. An opening or a cut-out portion may be formed simultaneously with the cutting out of the wooden piece from the raw wood. Alternatively, the opening or the cut-out portion may be formed via cutting or punching after the wooden piece is cut out from the raw wood.

(7) The compressed wood product formed by the method of processing wood according to the embodiment of the present invention can be applied as a jacket material to various electronic devices other than a digital camera, such as a portable communication terminal such as a portable telephone, a personal handyphone system (PHS) or a personal digital assistant (PDA), a portable audio device which mounts audio recording medium such as MD, CD, or cartridge tape to output sound, an IC recorder, a portable television, a portable radio, remote controls of various home appliances, and a digital video. Further, the compressed wood product according to the embodiments can be employed for purposes other than as a jacket for electronic devices.

Embodiments which are achievable through suitable combination of the above-described first to fourth embodiments and other embodiments listed as (1) to (7) fall within the scope of the present invention. Thus, various modifications may be made without departing from the spirit or scope of the general inventive concept as defined by the appended claims and their equivalents.

What is claimed is:

1. A method of processing wood into a predetermined shape through compression, comprising:

compressing a first wooden piece into a first bowl-like three dimensional shape with an inner surface;

compressing a second wooden piece into a second bowl-like three dimensional shape slightly smaller than the compressed first wooden piece;

placing the compressed second wooden piece in the compressed first wooden piece; and compressing together the compressed first wooden piece and the compressed second wooden piece which are placed one on another.

2. The method according to claim 1, wherein the placing includes placing the compressed second wooden piece so that a direction of wooden fibers of the compressed second wooden piece intersect with a direction of wooden fibers of the compressed first wooden piece.

3. The method according to claim 1, wherein the first wooden piece is different from the second wooden piece in grain pattern.

4. The method according to claim 1, wherein the first wooden piece and the second wooden piece have substantially a same grain pattern, and the placing includes aligning the grain pattern of the second wooden piece with the grain pattern of the first wooden piece.

5. The method according to claim 1, further comprising providing a reinforcing member between the first wooden piece and the second wooden piece.

6. The method according to claim 1, further comprising providing an electronically functioning element between the first wooden piece and the second wooden piece.

7. The method according to claim 1, wherein the first wooden piece and the second wooden piece have substantially a same thickness.

8. The method according to claim 1, wherein the first wooden piece is different from the second wooden piece in thicknesses.

9. The method according to claim 1, wherein the first wooden piece and the second wooden piece are of a same wood species.

10. The method according to claim 1, wherein the first wooden piece is different from the second wooden piece in species.

11. The method according to claim 1, wherein the first wooden piece and the second wooden piece are separately compressed with substantially a same compression rate.

12. The method according to claim 1, wherein the first wooden piece and the second wooden piece are separately compressed with a different compression rate.

13. The method according to claim 1, wherein each of compressing a first wooden piece and a second wooden piece separately and compressing together the compressed first wooden piece and the compressed second wooden piece includes applying a compressing force to the wooden pieces by a pair of metal molds having respective shapes corresponding to shapes of deformed wood to be obtained.

* * * * *